US006671472B2

(12) United States Patent
Shimizu et al.

(10) Patent No.: US 6,671,472 B2
(45) Date of Patent: Dec. 30, 2003

(54) IMAGE FORMING APPARATUS, CONTROL METHOD THEREOF AND CONTROL PROGRAM THEREFOR

(75) Inventors: Hideki Shimizu, Chiba (JP); Hirokazu Takahashi, Chiba (JP); Seiji Shibaki, Ibaraki (JP); Ryosuke Sugasawa, Chiba (JP); Mitsuru Fuchisawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/095,052

(22) Filed: Mar. 12, 2002

(65) Prior Publication Data

US 2002/0131787 A1 Sep. 19, 2002

(30) Foreign Application Priority Data

Mar. 15, 2001 (JP) ..... 2001-074022
Apr. 13, 2001 (JP) ..... 2001-115392
Feb. 22, 2002 (JP) ..... 2002-045549

(51) Int. Cl.[7] ..... G03G 15/00
(52) U.S. Cl. ..... 399/82; 399/16; 399/45; 399/405
(58) Field of Search ..... 399/405, 82, 85, 399/45, 16, 18, 21

(56) References Cited

U.S. PATENT DOCUMENTS 4,496,238 A 1/1985 Tsukada et al. ..... 399/18
4,728,991 A 3/1988 Takayama et al. ..... 347/140
5,073,801 A * 12/1991 Haneda et al. ..... 399/45
5,151,735 A * 9/1992 Yamashita et al. ..... 399/18
5,280,308 A 1/1994 Takahashi et al. ..... 346/134
5,729,791 A * 3/1998 Kutsuwada et al. ..... 399/82
6,026,272 A 2/2000 Kusaka et al. ..... 399/327
6,272,297 B1 * 8/2001 Kobayashi ..... 399/82
6,393,232 B1 * 5/2002 Osari et al. ..... 399/82
2002/0118975 A1 * 8/2002 Asai ..... 399/45

FOREIGN PATENT DOCUMENTS

JP 06-030185 * 2/1994
JP 08-259095 * 10/1996
JP 08-331312 * 12/1996
JP 2001-233534 8/2001

* cited by examiner

*Primary Examiner*—Sophia S. Chen
(74) *Attorney, Agent, or Firm*—Fitzpatrick, Cella, Harper & Scinto

(57) ABSTRACT

The invention intends to provide the image forming apparatus with plural sheet discharge paths, to enable setting of appropriately selecting the discharge paths according to the copy mode/fax mode/printer mode, etc. and to enable appropriate automatic selection of the plural discharge paths according to other conditions. For this purpose, there are provided the plural discharge paths 21 to 24, which are respectively assigned to the copy mode/fax mode/printer mode, etc., and the sheet after image formation by the latent image forming drum 18 constituting the image forming means is discharged by one of the discharge paths 21 to 24 according to such setting. On the other hand, according to the function state of the apparatus, such as designation of a specified post-processing, designation of special paper or detection of a jam, a specified discharge path is selected for the sheet discharge regardless of the aforementioned setting.

55 Claims, 26 Drawing Sheets

IMAGE FORMING APPARATUS, CONTROL METHOD THEREOF AND CONTROL PROGRAM THEREFOR

BACKGROUND OF THE INVENTION

1. Field of the Invention

The present invention relates to an image forming apparatus for conveying a sheet into image forming means of a predetermined method, conducting image formation by such image forming means and then discharging the sheet from a discharge path, and a control method thereof and a control program therefor.

2. Related Background Art

There are conventionally known image forming apparatus utilizing various image forming mechanisms such as an electrophotographic recording method, an ink jet method, etc.

The image forming apparatus has conventionally been supplied principally as a single-function apparatus such as a facsimile apparatus, a copying machine or a printers as a computer peripheral, but is recently available also in so-called digital composite apparatus in which the printer is combined with a scanner for image reading, a facsimile function and/or a communicating function through a LAN.

In a multi-function image forming apparatus such as the digital composite apparatus, the functions are highly diversified and there are often required various functions such as a function of, after recording, classifying and discharging the sheets to the respectively different plural discharge trays, for example, for copying, for a PC printer, for facsimile, etc., a finisher function of executing highly diversified post-processing such as bookbinding or Z-folding, a function of recording on special paper such as a thick papers (or cardboard) or an OHP sheet and then discharging the paper.

For this reason, there have recently been proposed various configurations how various units for realizing such multiple functions can be accommodated within the limited space of a casing. An example of such examples is so-called in-body sheet-discharge system in which the scanner for image reading is provided in the upper part of the apparatus and the sheet discharging unit is provided in a cubic space constituted by a casing in the lower part of the apparatus.

However, in a configuration having plural sheet discharge paths, the apparatus inevitably becomes bulky if all the functions for passing special sheets and for highly advanced finishing are realized in all the plural discharge paths. Such drawback is particularly serious in case the limitation by the installed position of the sheet discharge path is large in the case of the in-body sheet discharge system.

SUMMARY OF THE INVENTION

An object of the present invention is to effectively provide an image forming apparatus with plural sheet discharge paths and incorporate various units for realizing multiple functions as mentioned in the foregoing within the limited space of the casing, utilizing such sheet discharge paths.

Another object of the present invention is to enable such setting as to suitably select the plural sheet discharge paths even in case functions have be limited in certain of the plural sheet discharge paths in consideration of the space within the casing of the apparatus, and to enable appropriate automatic selection of the plural sheet discharge paths according to other conditions.

Still another object of the present invention is to improve the operability of an original on an original table and of an operation unit by effectively providing the image forming apparatus with plural sheet discharge paths, and to enable passing of even a special sheet without damage thereto.

The above-mentioned objects can be attained according to an embodiment of the present invention, by an image forming apparatus comprising first reception means for receiving print data from an external terminal, second reception means for receiving read image data, discrimination means for discriminating whether the reception is made either from the first reception means or the second reception means, recording means for recording an image on a recording medium based on the received data, first discharge means and second discharge means for discharging the recording medium recorded by the recording means, discharge setting means for setting whether to discharge the recording medium to the first sheet discharge means or to the second sheet discharge means respectively corresponding to the first reception means and the second reception means, selection means for selecting either the first discharge means or the second discharge means, and special sheet setting means for setting a special paper as the type of the recording medium to be recorded by the recording means, wherein the selection means selects the first discharge means regardless of the setting by the discharge setting means in case the special paper is set by the special paper setting means.

According to the present invention, there is also provided an image forming apparatus comprising first reception means for receiving print data from an external terminal, second reception means for receiving read image data, discrimination means for discriminating whether the reception is made either from the first reception means or the second reception means, recording means for recording an image on a recording medium based on the received data, first discharge means and second discharge means for discharging the recording medium recorded by the recording means, discharge setting means for setting whether to discharge the recording medium to the first discharge means or to the second discharge means respectively corresponding to the first reception means and the second reception means, selection means for selecting either the first discharge means or the second discharge means, post-processing setting means for setting post-processing after the recording by the recording means, and post-processing means for executing the post-processing and connected to the second discharge means, wherein the selection means selects the second discharge means regardless of the setting by the discharge setting means in case the post-processing is set by the post-processing setting means.

According to the present invention, there is also provided an image forming apparatus comprising first reception means for receiving print data from an external terminal, second reception means for receiving read image data, discrimination means for discriminating whether the reception is made either from the first reception means or the second reception means, recording means for recording an image on a recording medium based on the received data, first discharge means and second discharge means for discharging the recording medium recorded by the recording means, discharge setting means for setting whether to discharge the recording medium to the first discharge means or to the second discharge means respectively corresponding to the first reception means and the second reception means, selection means for selecting either the first discharge means or the second discharge means, first detection means and second detection means for respectively detecting whether the first discharge means and the second discharge means are abnormal, wherein the selection means selects the first discharge means regardless of the setting by the discharge setting means in case the second detection means detects the abnormality in the second discharge means and the discharge to the first discharge means is possible.

According the present invention, there is also provided an image forming apparatus comprising first reception means for receiving print data from an external terminal, second reception means for receiving read image data, discrimination means for discriminating whether the reception is made either from the first reception means or the second reception means, recording means for recording an image on a recording medium based on the received data, first discharge means and second discharge means for discharging the recording medium recorded by the recording means, discharge setting means for setting whether to discharge the recording medium to the first discharge means or to the second discharge means respectively corresponding to the first reception means and the second reception means, selection means for selecting either the first discharge means or the second discharge means, special paper setting means for setting a special paper as the type of the recording medium to be recorded by the recording means, post-processing setting means for setting a post-processing after recording by the recording means, and post-processing means for executing the post-processing and connected to the second discharge means, wherein the selection means selects the first discharge means regardless of the setting by the discharge setting in case the special paper is set by the special sheet setting means and the selection means selects the second discharge means regardless of the setting by the discharge setting means in case the post-processing is set by the post-treatment setting means.

According to the present invention, there is also provided an image forming apparatus controlling program for controlling, from a remote external information processing terminal, an image forming apparatus provided with first reception means for receiving print data from an external terminal, reading means for reading an image and outputting read print data, and recording means for recording an image on a recording medium based on the received or read data. The apparatus further includes discrimination means for discriminating whether the reception is made either from the first reception means or the second reception means, first discharge means and second discharge means for discharging the recording medium recorded by the recording means, and sheet discharge setting means for setting whether to discharge the recording medium to the first discharge means or to the second discharge means respectively corresponding to the first reception means and the reading means, wherein the first discharge means is positioned between the reading means and the recording means and the second discharge means is connectable to a post-processing apparatus and is so positioned as to discharge the recording medium to the exterior of the apparatus. The apparatus further comprises selection means for selecting the first discharge means or the second discharge means. The program comprising a special paper setting step for setting a special paper as the type of the recording medium, and a post-processing setting step for setting a post-processing after recording by the recording means, thereby exclusively selecting the special sheet setting means and the post-processing setting means.

Still other objects of the present invention, and the features thereof, will become fully apparent from the following description, which is to be taken in conjunction with the accompanying drawings.

DESCRIPTION OF THE PREFERRED EMBODIMENTS

Now the present invention will be clarified by embodiments thereof, with reference to the accompanying drawings. In the following there will be explained an embodiment in the form of a digital composite apparatus, which is formed by combining a printer with a scanner for image reading, a facsimile function, a communication function for communication through a LAN, etc. In the following embodiment, the recording method is assumed to be the electrophotographic method.

Figure 1:
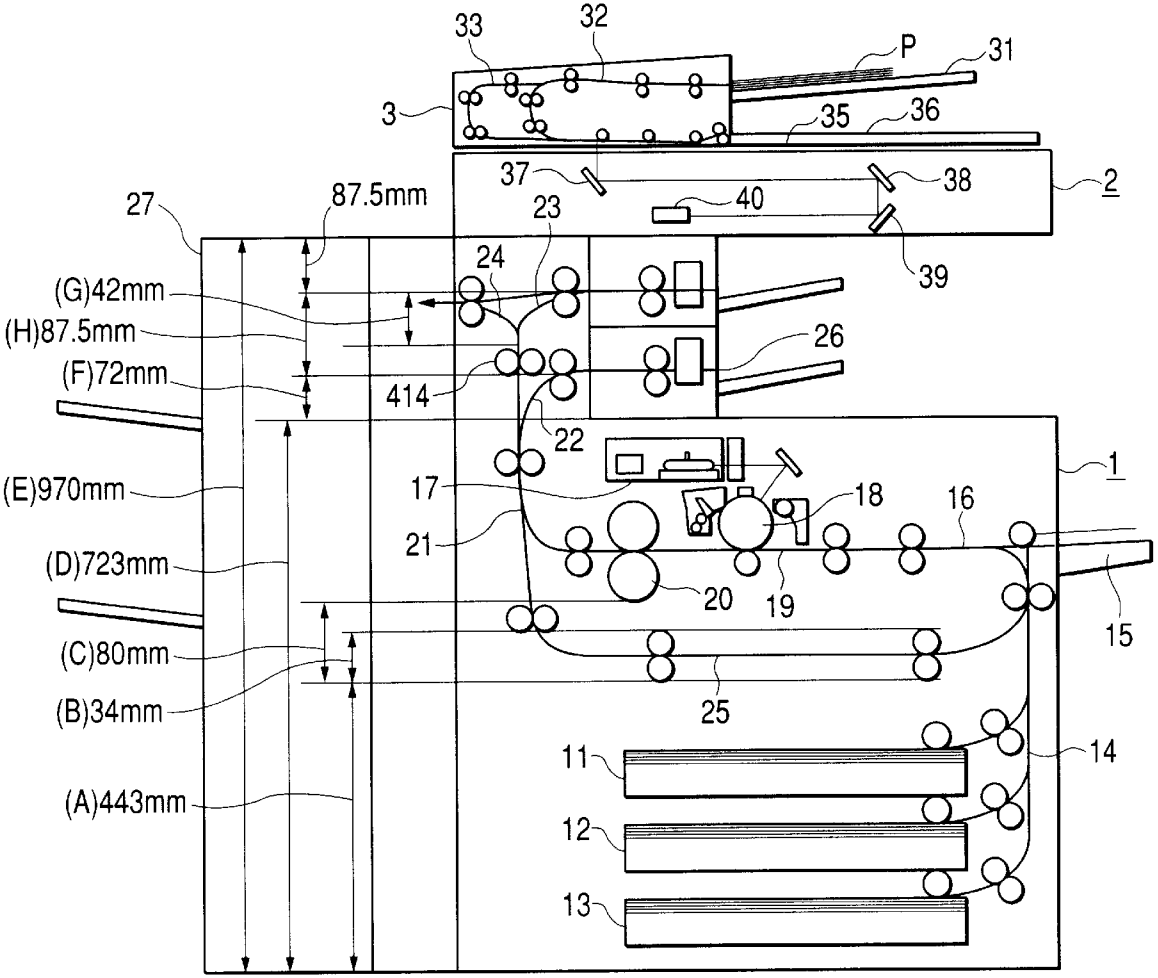
FIG. 1 is a cross-sectional view of an image forming apparatus embodying the present invention.

FIG. 1 schematically shows the hardware configuration of a digital composite apparatus embodying the present invention, principally showing the configuration of a sheet conveying system in an image reading system and an image recording system.

Referring to FIG. 1, there are shown an electrophotographic recording unit 1, an original table 2 for reading an original, and an automatic original feeding unit 3 for feeding the original to a reading position. The original table 2 is also provided with an unrepresented operation unit. There are also shown sheet cassette 11, 12, 13 for feeding recording sheets, a conveying path 14 for conveying the sheet fed from the sheet cassettes 11 to 13, and a manual sheet insertion unit 15.

There are also shown a conveying path 16 for guiding the sheet, fed from the sheet cassettes 11 to 13 or the manual sheet insertion unit 15, to an image forming unit (17, 18, 19, 20), a laser unit 17 for receiving an image signal and generating laser light corresponding to the image signal, a latent image forming drum 18 for generating a latent image based on the generated laser light, a transfer roller 19 for transferring a toner image, formed by developing the latent image formed on the latent image forming drum 18, onto a sheet, and thermal fixation rollers 20 for fixing the image transferred onto the sheet by the transfer roller 19.

There are also shown a conveying path 21 for conveying the sheet processed in the thermal fixation unit 20 to a discharge section or a dual-side path 25, a first sheet discharge path 22, a second sheet discharge path 23 and a third sheet discharge path 24.

The first discharge path 22 has a smaller curvature (in general, reciprocal of the radius of curvature, the curving being less for a smaller curvature) than in the second and third discharge paths 23, 24. This is because, as the original table 2 is positioned in the upper part, the apparatus inevitably becomes bulky and the convenience of use thereof (original handling on the original table 2 or operability of the operation unit) is deteriorated if the curvature of the conveying path is made smaller (if the curving is made milder) in the second and third discharge paths 23, 24. In case the dual-side path 25 for sheet re-feeding is positioned under the latent image forming drum 18, the transfer roller 19 and the thermal fixation rollers 20 as in the present embodiment, the limitation on the height of the apparatus inevitably becomes harder to meet. Also in such configuration, the curvature of the second and third discharge paths 23, 24 in the upper side cannot be made smaller since it is not possible to elongate the distance to a conveying roller 414 (to be explained later) immediately in front of the second and third discharge paths 23, 24 or to dispense with such conveying roller 414.

In such configuration, the first discharge path 22 of the smaller curvature can pass the sheet of various types (special papers) such as cardboard (or thick paper), thin paper, postcard, free-size sheet, etc. (stated differently, such special paper can only be discharged from the first discharge path 22). The second and third discharge paths, having a larger curvature, is not suitable for passing the special paper but is suitable for discharging the ordinary paper. Also the installation area (footprint) of the apparatus can be made smaller by positioning the second discharge path above the first discharge path. The dual-side path 25 for recording on both sides of the sheet is provided with plural rollers and is so constructed as to invert and re-feed a sheet of which one side was subjected to the recording, by the laser unit 17, the latent image forming drum 18, the transfer roller 19 and the thermal fixation roller 20.

A finisher 26 is rendered connectable to the second discharge path 23 and the third discharge path 24. The finisher 26 is formed compact since the original table 2 is positioned in the upper part and has limited functions such as tray shifting, stapling, etc.

On the other hand, a finisher 27 connectable to the third sheet discharge path can be of a large size and can have multiple functions since it is not dimensionally limited in the upper or lower part. Thus, there can be realized such functions as stapling, Z-folding, book binding, punching, etc. Such arrangement of the third discharge path allows to limit the height of the apparatus and to improve the convenience of use of the apparatus (original handling on the original table 2 or operability of the operation unit).

The two finishers 26, 27 need not be both connected, but may be sold as optional units according to the desire of the customer. For example the finisher 26 is supplied to a user who does not desire a large installation area of the apparatus, while the finisher 27 is supplied to a user who wishes a finisher of high performance even if the size thereof is large. The first discharge path 22 is always used even in case neither of the finishers 26, 27 are connected, so that at least the first discharge path 22 is so constructed as to be capable of passing the sheet of various types (cardboard, thin paper, postcard, free-size sheet, etc.). Such configuration provides the following advantages in case an existing printer is utilized for constructing a composite apparatus as in the present embodiment by attaching a scanner, an operation unit, a sheet discharge section, etc. in the upper part of the printer. Firstly, there is obtained an advantage that the apparatus can be easily constructed by merely attaching a second discharge path, simply utilizing the first discharge path capable of passing the sheet of various types in the original existing printer. Also there is obtained an advantage that the first discharge path 22, being shortest sheet conveying path, least damages the sheet. Moreover, the present apparatus is constructed as a digital composite apparatus and is rendered capable of being utilized as a printer or a scanner of a client terminal on a LAN, also recording data or outputting a copy of facsimile data or the like received through a public line. Therefore, the apparatus has such a configuration capable of setting the discharge path for the recorded print of the printer, facsimile or copying operation respectively from one of the first to third discharge paths.

In the original table 2 shown in the upper part of FIG. 1, there are shown an original P, an original tray 31, an original conveying path 32, an original P of which the rear surface is to be read, an original discharge path 33 for reading the original in conveying motion and discharging such original onto an original discharge tray, an original discharge tray 36 for stacking the read originals, an original support table 35 for reading a book-type original, mirrors 37, 38, 39 for guiding the light reflected from the original to a reading sensor 40, and the reading sensor 40 comprises a reading element composed of a CCD for photoelectric conversion of the light reflected from the original.

As an example, there will be explained the dimensions of the various units shown in FIG. 1. The distance A from the bottom face of the apparatus to the dual-side path is 443 mm, the height B in the dual-side path is 34 mm, the distance C from the dual-side path to the position of the fixing rollers is 80 mm, the distance D from the bottom face of the apparatus to the starting position of curvature of the first discharge path is 723 mm, and the distance E from the bottom face of the apparatus to the original table (operation unit) is 970 mm. It is empirically known that the height of the operation unit or the original table is desirably about 970 mm in consideration of the operability. Therefore, it is necessary to position the first and second discharge paths within a height range of 723 to 970 mm from the bottom face of the apparatus. Also the height difference F between the start position of curvature of the first discharge path and the discharge position thereof is selected as 72 mm, while the height difference G between the start position of curvature of the second discharge path and the discharge position thereof is selected as 42 mm, and the height difference H between the discharge positions of the first and second discharge paths is 87.5 mm. These dimensions are determined in consideration of the stacking ability for the discharged sheets and the ease of mounting of the finisher 26. The radius of curvature r is 48 mm at the starting position of curvature of the first discharge path, and is 30 mm at the starting position of curvature of the second discharge path. The radius of curvature of 48 mm corresponds to a suitable curvature experimentally determined for passing the special papers.

Figure 2:
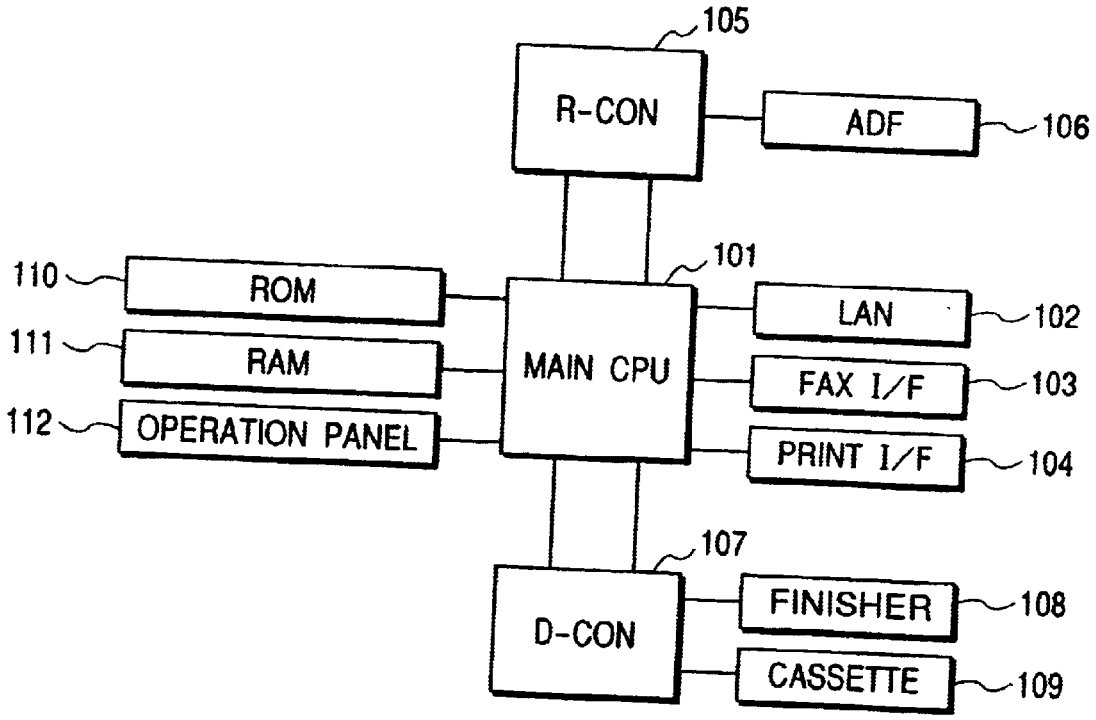
FIG. 2 is a block diagram of the image forming apparatus embodying the present invention.

FIG. 2 shows the configuration of a control system of the apparatus shown in FIG. 1. Referring to FIG. 2, a main CPU 101 constitutes a controller for controlling the entire apparatus and controls a reading control unit 105 (corresponding to the original table 2 in FIG. 1) and an electrophotographic recording unit 107 (corresponding to the electrophotographic recording unit 1 in FIG. 1). A reading control unit 105 controls an automatic document feeder (ADF) 106. The electrophotographic recording unit 107 controls a laser unit 17, a photosensitive drum 18, the transfer unit 19, the thermal fixation unit 20, various motors, a finisher 108 and sheet cassettes 109. The CPU 101 executes control according to a program stored in a ROM 110.

In FIG. 2, there are shown the reading control unit 105 for transmitting read image data to the CPU 101, a LAN interface unit 102 for data exchange with a client on a LAN, a FAX interface unit 103 constituting an interface with a FAX unit for facsimile transmission and reception, a printer interface unit 104 for controlling an interface with a PDL development unit for executing image data development by interpreting the printer description language or the like, and an operation panel 112 for executing various settings or issuing various commands such as copy or FAX, and the CPU 101 is connected with and controls the above-mentioned blocks to achieve the desired operation. A RAM 111 is used for example as a work area for executing the program.

Based on the control by the control panel 112 or a PC terminal on the LAN, the CPU 101 controls various units so as to output print from the LAN, facsimile print or copy. In such operation, it is possible to set which of the first to third discharge paths 22 to 24 (FIG. 1) is to be used by the electrophotographic recording unit 107, based on the control by the operation 112 or the PC terminal on the LAN, and such setting information can be stored in the RAM 111. Thus the print of the printer, the FAX print and the copy are discharged in classified manner, so that the user can easily take out the desired print.

In case a special paper such as cardboard, thin paper, OHP sheet or free-size sheet is selected as the sheet, the CPU 101 executes discharge from the first discharge path under control to be explained later, regardless of the setting of the discharge path. Such control minimizes the danger of damaging the special paper since the first discharge path has the smallest curvature. In this manner the discharge path for the special paper can be utilized without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-processing function need not be provided in all the plural discharge Paths. Also the first discharge path, being the shortest sheet conveying path, minimizes the danger of damaging the sheet even in case of passing the special paper. Also such smaller curvature than in other discharge paths and such control of the apparatus allow to limit the height of the apparatus and to improve the convenience of use of the apparatus (original handing on the original table 2 and operability of the operation unit). Also the configuration of placing the dual-side path 25 under the latent image forming drum 18, the transfer roller 19 and the thermal fixation rollers 20 allows to meet the strict requirement in the height of the apparatus.

Also the unrepresented large-sized finisher 27 capable of Z-folding, book binding, etc. can be connected to the third discharge path 23 shown in FIG. 1. In the present apparatus, because of the presence of the reading unit in the upper part of the apparatus, the large-sized finisher capable of Z-folding, book binding, etc. cannot be mounted on the first or second discharge path 22, 23. Therefore, the CPU 101 designates the third discharge path regardless of the aforementioned setting of the discharge path in case a function such as Z-folding or book binding is designated by the control to be explained later. In this manner the specified finisher function can be utilized without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-treatment function need not be provided in all the plural discharge paths.

Such configuration allows to limit the height of the apparatus and to improve the convenience of use of the apparatus (original handing on the original table 2 and operability of the operation unit). Also in case of placing the dual-side path 25 under the latent image forming drum 18, the transfer roller 19 and the thermal fixation rollers 20, there can be met the strict requirement in the height of the apparatus.

Figure 3:
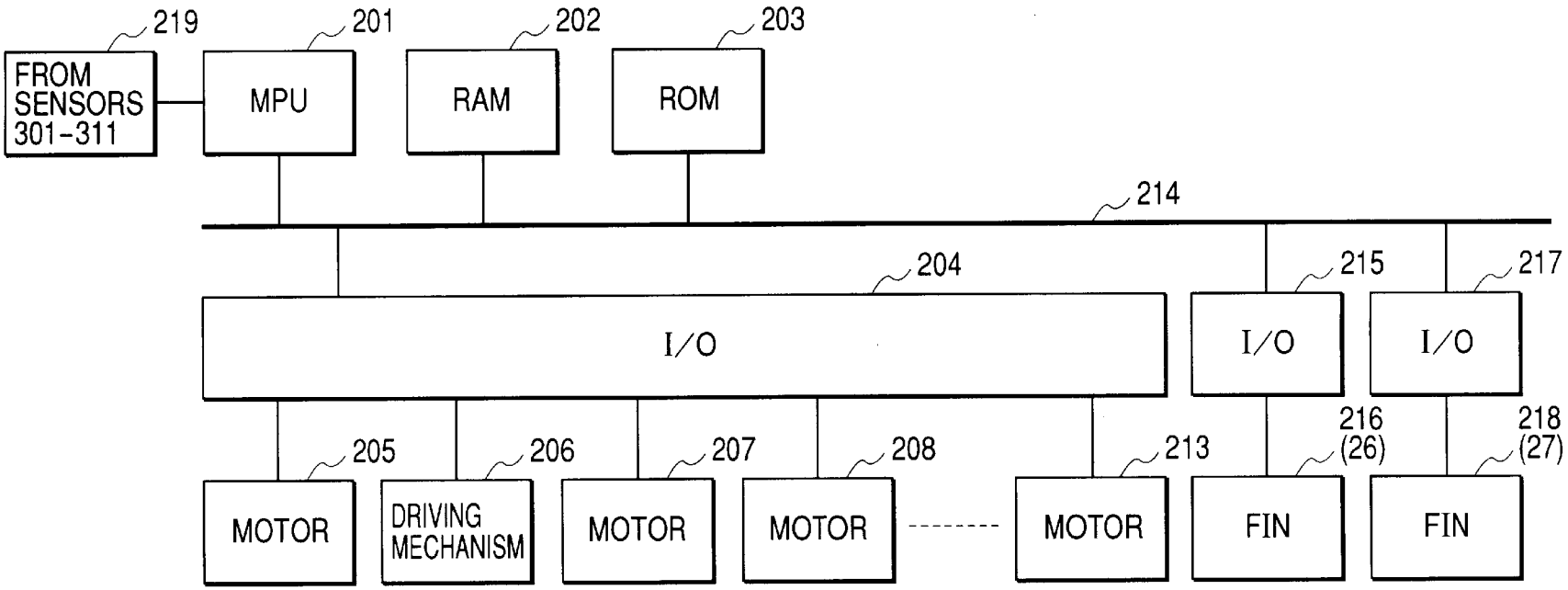
FIG. 3 is a block diagram of an electrophotographic recording unit of the image forming apparatus embodying the present invention.

FIG. 3 is a view showing a more detailed configuration of the electrophotographic recording unit 107 shown in FIG. 2, wherein an MPU 201 controls various motors to be explained later, emission of the laser light in a latent image forming unit, voltage of a charging unit and temperature of the thermal fixation unit under the instruction from the CPU 101.

A RAM 202 is used as a work area for the MPU 201 in executing various programs, and a ROM 203 stores programs for the MPU 201. In the present embodiment, the programs of the MPU 201 are stored in the ROM 203, but there may also be used any medium capable of storing a program such as a hard disk or a CD-ROM.

An I/O port 204 is provided between a motor driver and a system bus 214 of the MPU 201, and is used for controlling following motors.

A stepping motor 205 is used for picking up a sheet from the sheet cassettes 11 to 13.

A driving mechanism 206, for conveying the picked up sheet, may be composed of an independent motor, but, in the present embodiment, is composed of a speed varying mechanism (or transmission) connected to a main motor 208 to be explained later and a clutch (not shown). The MPU 201 is rendered capable of controlling at least such clutch through the I/O port 204.

Other motors 207 to 213 are composed of respectively independent motors and includes a motor 207 for further guiding the sheet to the image forming unit, a motor 208 for driving the latent image forming unit and the transfer unit for executing formation of the latent image and image transfer onto the sheet, a DC motor 209 for driving the thermal fixation unit, a stepping motor 210 for conveying and discharging the sheet after image formation, a stepping motor 212 for discharging the sheet after image formation to another discharge section, and a stepping motor 213 for discharging the sheet to second and third discharge ports.

The above-described configuration employing stepping motors particularly in the motors 205, 206, 207, 210, 212 and 213 provides the advantage of setting various target speeds, also easily controlling acceleration and deceleration, and achieving the acceleration and deceleration control at a low noise level.

There are also shown a system bus 214, an I/O port 215 provided between the finisher 26 and the system bus 214, a finisher 216 corresponding to that 26 in FIG. 1, an I/O port 217 provided between the finisher 27 and the system bus 214, and a finisher 218 corresponding to that 27 in FIG. 1.

The MPU 201 is capable of recognizing the type, function, state, etc. of the mounted finisher through an I/O port 215. An I/O port 219 is provided for transmitting information, indicating the state of sensors 301 to 311, to the MPU 201.

Figure 4:
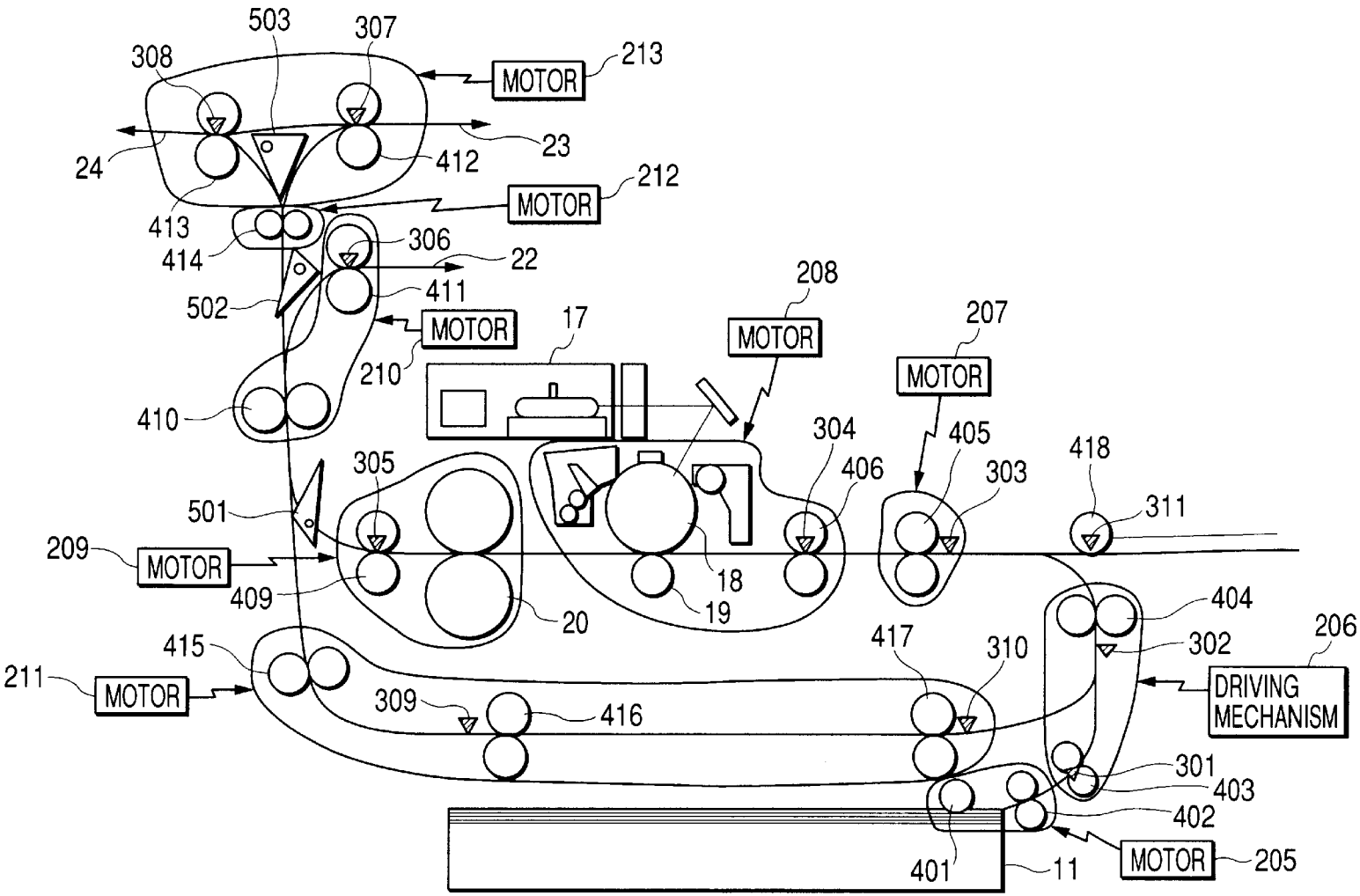
FIG. 4 is a cross-sectional view of the electrophotographic recording unit of the image forming apparatus embodying the present invention.

FIG. 4 shows the detailed configuration of a sheet conveying system in the electrophotographic recording unit 1 of the apparatus shown in FIG. 1. FIG. 4 shows the electrophotographic recording unit 1 of the apparatus of FIG. 1 in a magnified manner, wherein motors for driving various rollers are indicated by numbers same as those in FIG. 3, and the rollers driven by a same motor are indicated by a curved circle.

In FIG. 4, the sensors 301 to 311 for detecting the presence or absence of sheet are composed for example of optical sensors.

A roller 401 for picking up the sheet and rollers 402 for conveying the sheet are driven by the motor 205. FIG. 4 only shows the configuration on the cassette 11, but other cassettes are provided with similar configurations.

The motor 205 can be composed of a stepping motor. The roller 401 for picking up the sheet is normally in a position separated from the sheet on the cassette 11, but is pressed thereto at a timing of picking up the sheet. The power source for pressing the roller 401 to the sheet on the cassette 11 may be composed of an unrepresented independent motor or solenoid, but, in the present embodiment, the driving power of the motor 208 is utilized to control the contact/separation of the roller 401 with or from the sheet through levers, cams, etc. The motor 205 drives the rollers 401, 402 so as to convey the sheet with a sheet conveying speed of 210 mm/sec.

Rollers 403, 404 for vertically conveying the sheet fed from the cassettes in the lower part of the apparatus or from the dual-side unit to be explained later and executing registration of the sheet are driven by a driving mechanism 206. As explained in the foregoing, the driving mechanism 206 is connected to the main motor 208 through an unrepresented clutch and an unrepresented speed varying mechanism (or transmission), and drives the rollers 403, 404 so as to convey the sheet with a sheet conveying speed of 280 mm/sec. Such speed is a double of the speed of the main motor 208 as will be explained later.

Rollers 405 for sheet conveying and registration are driven by the motor 207, which can also be composed of a stepping motor. The motor 207 drives the rollers 405 in such a manner that the sheet conveying speed is decelerated from 280 mm/sec to 140 mm/sec which is same as the speed of the main motor 208 to be explained later.

Rollers 406 for conveying the sheet and a transfer roller 19 for transferring a toner image, obtained by developing the latent image, onto the sheet, are driven by the main motor 208. The latent image forming drum 18 and the transfer roller 19 are also driven by the main motor 208, which has the sheet conveying speed of 140 mm/sec.

The thermal fixation roller 20 for fixing the image transferred onto the sheet and rollers 409 for conveying the sheet toward the discharge paths are driven by the motor 209. The motor 209 is composed of a DC motor and has a sheet conveying speed of 140 mm/sec which is same as that of the main motor 208.

Rollers 410, 411 for conveying the sheet toward the first discharge path 22 are driven by the motor 210, which can be composed of a stepping motor. The motor 210 is capable of providing the sheet conveying speed from 140 mm/sec same as that of the main motor 208 to 350 mm/sec at maximum.

Rollers 412, 413 for conveying the sheet toward the second and third discharge paths 23, 24 are driven by the stepping motor 213, which is capable of providing the sheet conveying speed from 140 mm/sec same as that of the main motor 208 to 350 mm/sec at maximum.

Rollers 415, 416, 417 for conveying the sheet in the dual-side unit are driven by the motor 211, which can be composed of a stepping motor. The motor 211 is capable of providing the sheet conveying speed from 140 mm/sec same as that of the main motor 208 to 350 mm/sec at maximum.

In the present embodiment, the dual-side recording is made possible by inverting and re-feeding the sheet by the rollers 415, 416, 417 to the rollers 404, 418, 405, . . . , but, since the apparatus is made compact in the vertical size, the dual-side unit has a relatively short distance between the rollers 417 and 405 in such a manner that the rollers 417 and 405 simultaneously engage with the rear and front ends of a long sheet for example of A3 size.

Rollers 414 for conveying the sheet are driven by the motor 212, which can be composed of a stepping motor. The motor 212 is capable of providing the sheet conveying speed from 140 mm/sec same as that of the main motor 208 to 350 mm/sec at maximum.

A flapper 501 is provided for switching the conveying path so as to guide the sheet from the main conveying path including the latent image forming drum 18 either to discharge paths in the upper left part of the drawing or to the dual-side unit in the lower part.

There are also provided a flapper 502 for switching the sheet discharge direction either toward the first discharge path 22 or toward the second and third discharge paths 23, 24, and a flapper 503 for switching the sheet discharge direction either toward the second discharge path 23 or toward the third discharge path 24.

As explained in the foregoing, the curvature of the first discharge path 22 is made smaller than that of the second and third discharge paths 23, 24.

In the following there will be explained the function of the above-described configuration.

In the present embodiment, the conveying system around the image forming means, namely around the latent image forming drum 18 (driven by the motor 208) is capable of conveying the sheet with a speed of 140 mm/sec. Conventionally, it is common to select the speed of other sheet conveying systems same as that of the sheet conveying system around the image forming means, but, in the present embodiment, in conveying systems other than that for the image forming means (namely driven by a different drive source) the sheet is conveyed at a speed as far as possible than in the conveying system of the image forming means. More specifically, in the present embodiment, the conveying system around the latent image forming drum 18 has a speed of 140 mm/sec but the conveying systems driven by other drive sources employ the conveying speed of 210, 280 or 350 mm/sec. The details of the speed control will be explained later, but, in order to achieve the conveying speed control explained above, the conveying speed is decelerated to 140 mm/sec mentioned above by the rollers 405 in front of the latent image forming drum 18 and the sheet is conveyed with the aforementioned higher speed as far as possible in front of or after the latent image forming drum 18.

Also in order to prevent the defects such as sheet breakage resulting from the speed difference in employing different conveying speeds in different portions of the conveying paths, the driving force of the driving mechanism at the upstream side (namely driving mechanism 206 in the present embodiment) is released whenever necessary. For example there is a timing where the rollers 417 and 405 simultaneously engage with the rear and front ends of the sheet as explained in the foregoing, and the clutch of the driving mechanism 206 at the upstream side is released when the deceleration is started by the rollers 405.

Also in the present embodiment, the user can set in advance the sheet discharge paths to specified applications. For example the first to third discharge paths 22 to 24 are respectively assigned to the copy mode/FAX mode/printer mode. Thus, the recorded result of the FAX reception is outputted to a specified one of the discharge paths. Otherwise, the first to third discharge paths 22 to 24 are respectively assigned for example to a specified job, a user or a client terminal generating a print command. Thus the recorded result of a print job received from a certain client terminal is outputted to a specified one of the discharge paths. In this manner the user can easily take out the desired print since the apparatus discharges the prints of the printer mode, FAX mode and copy mode in classified manner.

The present embodiment, in addition to the aforementioned user setting for the discharge paths, executes sheet discharge by automatically selecting a discharge path different from the user setting of the discharge paths under specified conditions. In the present embodiment, in case a specified finisher function (such as book binding or folding) is designated, the user setting for the discharge paths is disregarded and there is automatically selected a discharge path that can be utilized by such finisher function. Also in case an error such as jamming is detected in the discharge path determined by the user setting, such user setting for the discharge paths is disregarded and there is automatically selected another discharge path free of the error. Also in case a special paper is selected, there is automatically selected the discharge path capable of discharging such special paper.

In this manner there can be utilized the specified finisher function or the discharge path capable of discharging the special paper or free of error, without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-processing function need not be provided in all the plural discharge paths.

In the following there will be given a further detailed explanation on the sheet conveying control of the recording unit in the above-described configuration, with reference to flow charts in FIG. 5 and ensuing drawings.

The CPU 101 executes the following process according to a program stored in the ROM 110. FIG. 5 shows a start factor monitoring task executed by the CPU 101 for example at every 5 msec.

The start factor monitoring task discriminates commands entered by predetermined operations in the PC terminal on the LAN, the FAX unit 103 for executing facsimile transmission and reception, or the operation panel 112, and activates respectively corresponding tasks.

The start factor monitoring task at first discriminates whether a print command is received (step S101), and, if received, activates a discharge path selecting task (S104).

In case the print command is not received, there is discriminated whether the setting information for the discharge section is to be changed (S102), and if to be changed, there is activated a discharge section changing task (S105). If not to be changed, there is discriminated whether the special paper is set (S103), and, in case of special paper setting, there is activated a special paper setting task (S106).

Figure 6:
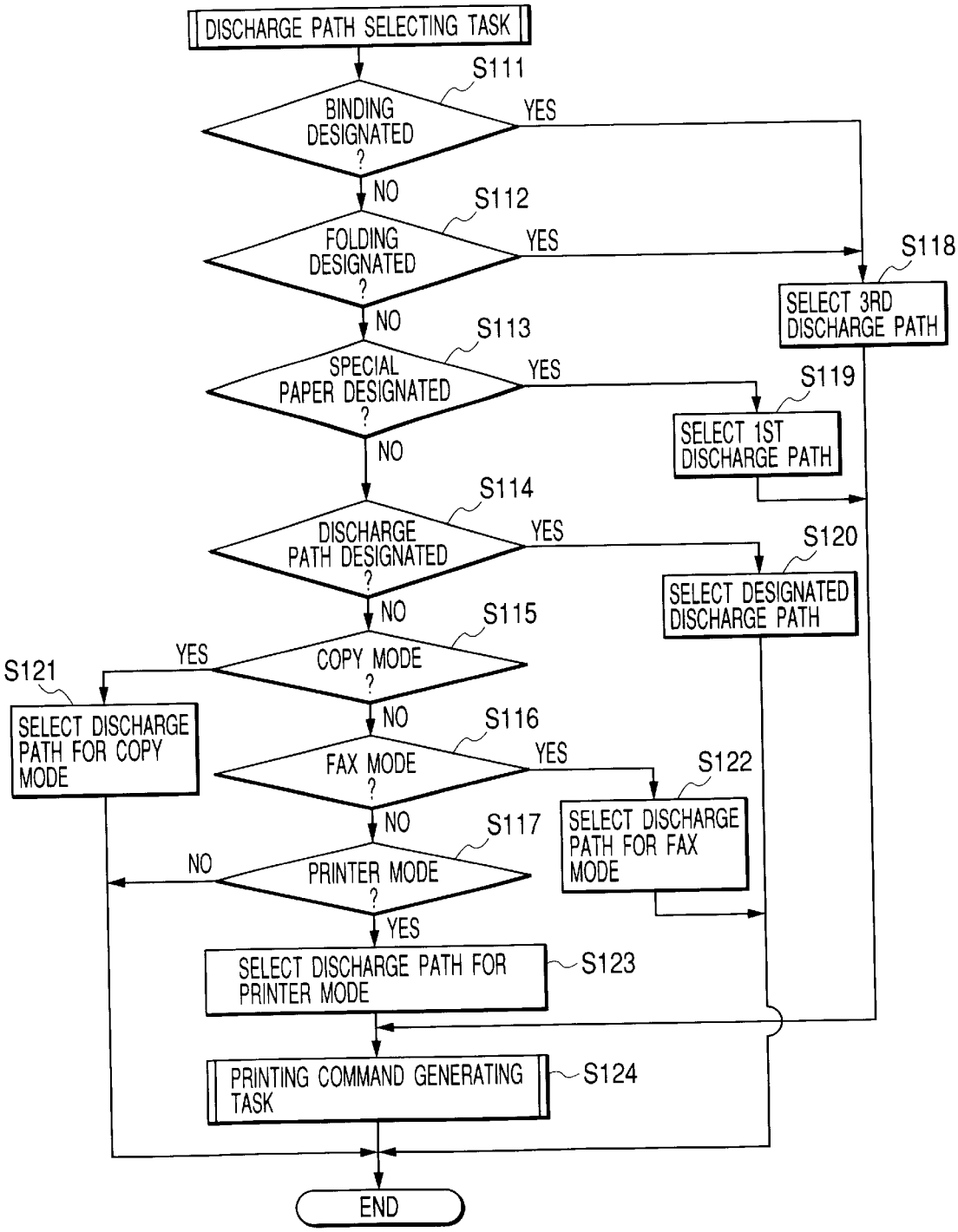
FIG. 6 is a flow chart of a discharge path selecting task to be executed by the main CPU 101 shown in FIG. 2.

FIG. 6 shows the discharge path selecting task (step S104), which, upon activation, discriminates whether there is designated a function specific to the large-sized finisher 27 such as book binding or Z-folding (steps S111, S112). If designated, the third discharge path capable of connecting the finisher 27 is selected (S118). Also the positioning of the third discharge path on a lateral face of the apparatus not dimensionally limited in the upward or downward direction allows to limit the height of the apparatus and to improve the convenience of use of the apparatus (original handing on the original table 2 and operability of the operation unit). Also the configuration of placing the dual-side path 25 under the latent image forming drum 18, the transfer roller 19 and the thermal fixation rollers 20 allows to meet the strict requirement in the height of the apparatus. In this manner the specified finisher function can be utilized without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-processing function need not be provided in all the plural discharge paths.

Then there is discriminated whether special paper such as cardboard, thin paper, OHP sheet or free-size sheet (S113), and, if set, the first discharge path 22 is selected (S119). Such selection of the first discharge path 22 avoids damage to the sheet and prevents troubles such as sheet jamming, since the first discharge path 22 has a smaller curvature than in other discharge paths (cf. FIG. 1) and also since it is the shortest sheet conveying path. Such control allows to limit the height of the apparatus and to improve the convenience of use of the apparatus (original handing on the original table 2 and operability of the operation unit). Also the configuration of placing the dual-side path 25 under the latent image forming drum 18, the transfer roller 19 and the thermal fixation rollers 20 allows to meet the strict requirement in the height of the apparatus. Also the discharge path capable of discharging the special paper can be utilized without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-processing function need not be provided in all the plural discharge paths.

In case the Z-folding, book binding or special paper is not set, there is discriminated whether the discharge path is set by a print command entered from an external computer or the like or by the operation panel 112 (S114). If the discharge path is already set, there is selected a discharge path according to such setting (S120).

In case the discharge path is not set, there is discriminated whether the entered print command is by a copy instruction (S115). In case the printing is activated by a copy instruction, there is selected a discharge path for which the copying is set in advance (S121). If it is not by a copy instruction, there is discriminated whether it is by facsimile (S116). In case the print command is instructed by facsimile, there is selected a discharge path for which the facsimile is set in advance (S122). In case the print command is not instructed by facsimile, there is discriminated whether the print command is from a PC terminal on the LAN (S117). If so, there is selected the discharge path set therefor (S123). In this manner the user can easily take out the desired print since the apparatus discharges the prints of the printer mode, FAX mode and copy mode in classified manner. Upon selection of the set discharge path, there is activated a print instruction command generating task (S124) whereupon the present task is terminated. Also in case the print command is not from the PC terminal on the LAN, the present task is terminated. In the steps S115 to S117, there is assumed the use of the print command having such a format allowing discrimination of the image input means utilized for image input by the judgment of the print command itself, but equivalent discrimination is naturally possible by directly judging whether the image input means utilized for image input is the FAX interface unit 103, the LAN interface unit 102 or the printer interface unit 104.

Thus, in the discriminating sequence shown in FIG. 6, the priority is at first given to the setting of book binding, folding or special paper in the steps S111 to S113. Next priority is given to the discharge setting determined by the print command or by the operation panel 112. The discharge path setting determined by the copy mode/FAX mode/printer mode has the lowest priority. Stated differently, there is normally utilized the discharge path determined according to the copy mode/FAX mode/printer mode, but, in case the function of a specified discharge path (third discharge path in the present embodiment) is required for example for the setting of book binding, folding or special paper, there is selected such discharge path. Stated differently, in case the sheet discharge is set (temporarily or forcedly) by the print command or from the operation panel 112, there is selected the discharge path according to such setting. In this manner the user can easily take out the desired print since the apparatus discharges the prints of the printer mode, FAX mode and copy mode in classified manner. Also the discharge path for specified finisher function or for passing the special paper can be utilized without a cumbersome operation of changing the discharge path for the print of the printer, the FAX print or the copy each time, whereby the throughput of the apparatus can be improved. Also such configuration allows to provide a compact apparatus, since the function for passing the special paper or the high performance post-processing function need not be provided in all the plural discharge paths.

In FIG. 6, the discharge path selecting task has been explained as the control by the CPU 101, but a similar control may be executed in the printer driver of the PC terminal on the LAN. If suitable communication means and protocol are given, it is easy for those skilled in the art to execute the discharge path selecting control, similar to that explained in the foregoing, by the printer driver of the PC terminal while acquiring the status of the present apparatus serving as a printer.

Figure 7:
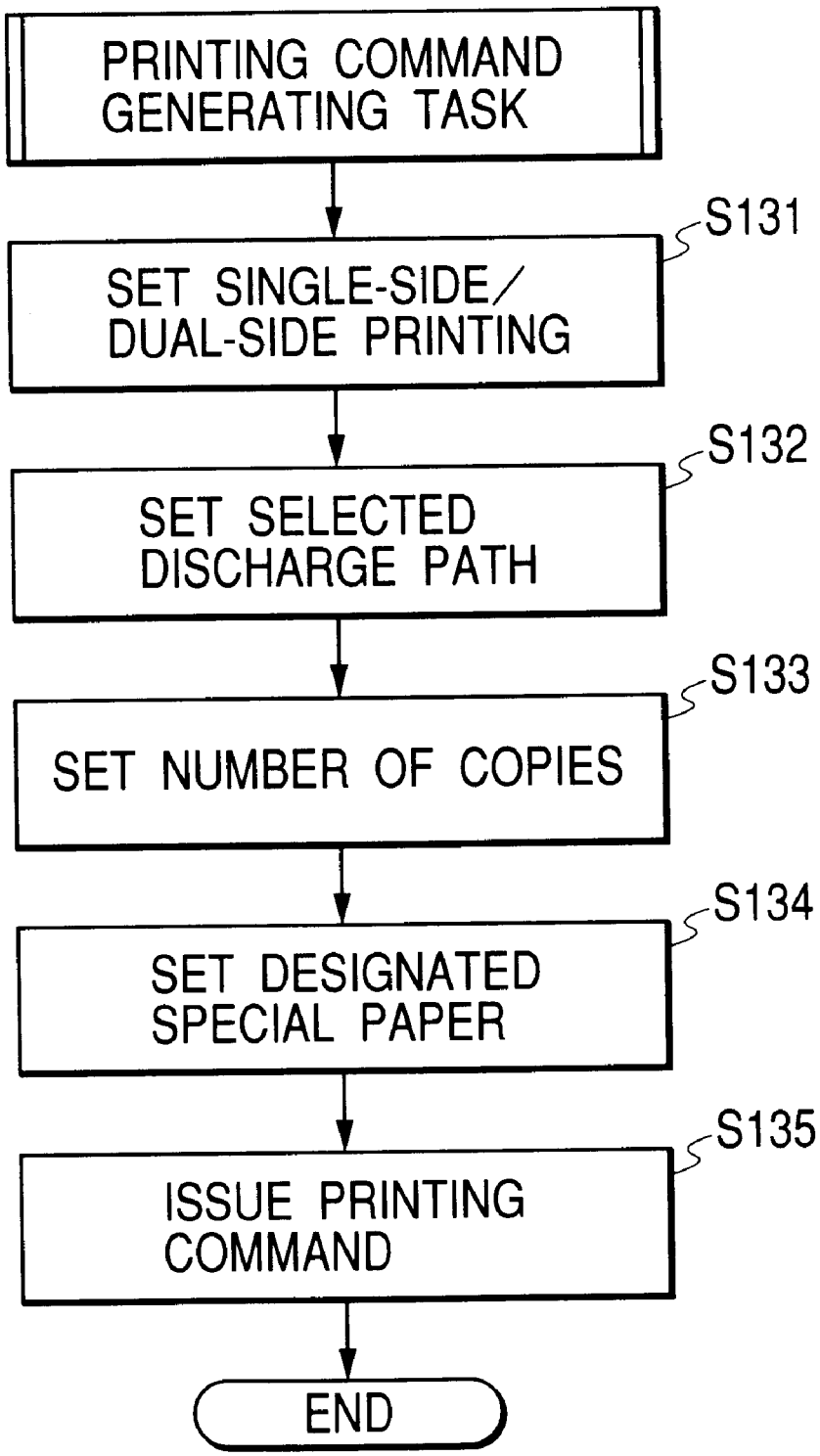
FIG. 7 is a flow chart of a printing command generating task to be executed by the main CPU 101 shown in FIG. 2.

FIG. 7 shows a print instruction command generating task, which generates a print instruction command describing the content of a print process to be executed by the electrophotographic recording unit 107 in a specified format and issuing such command to the electrophotographic recording unit 107.

Referring to FIG. 7, there is at first set either dual-side printing or single-side printing in the print instruction command, based in the input print command (step S131). Then there are set the discharge path information selected in the discharge path selecting task (S132), and the number of prints (S133). Then there is set special paper information (S134) set in a special paper setting task to be explained later, and thus generated print instruction command is outputted, together with the print data, to the electrophotographic recording unit 107 (S135).

Figure 8:
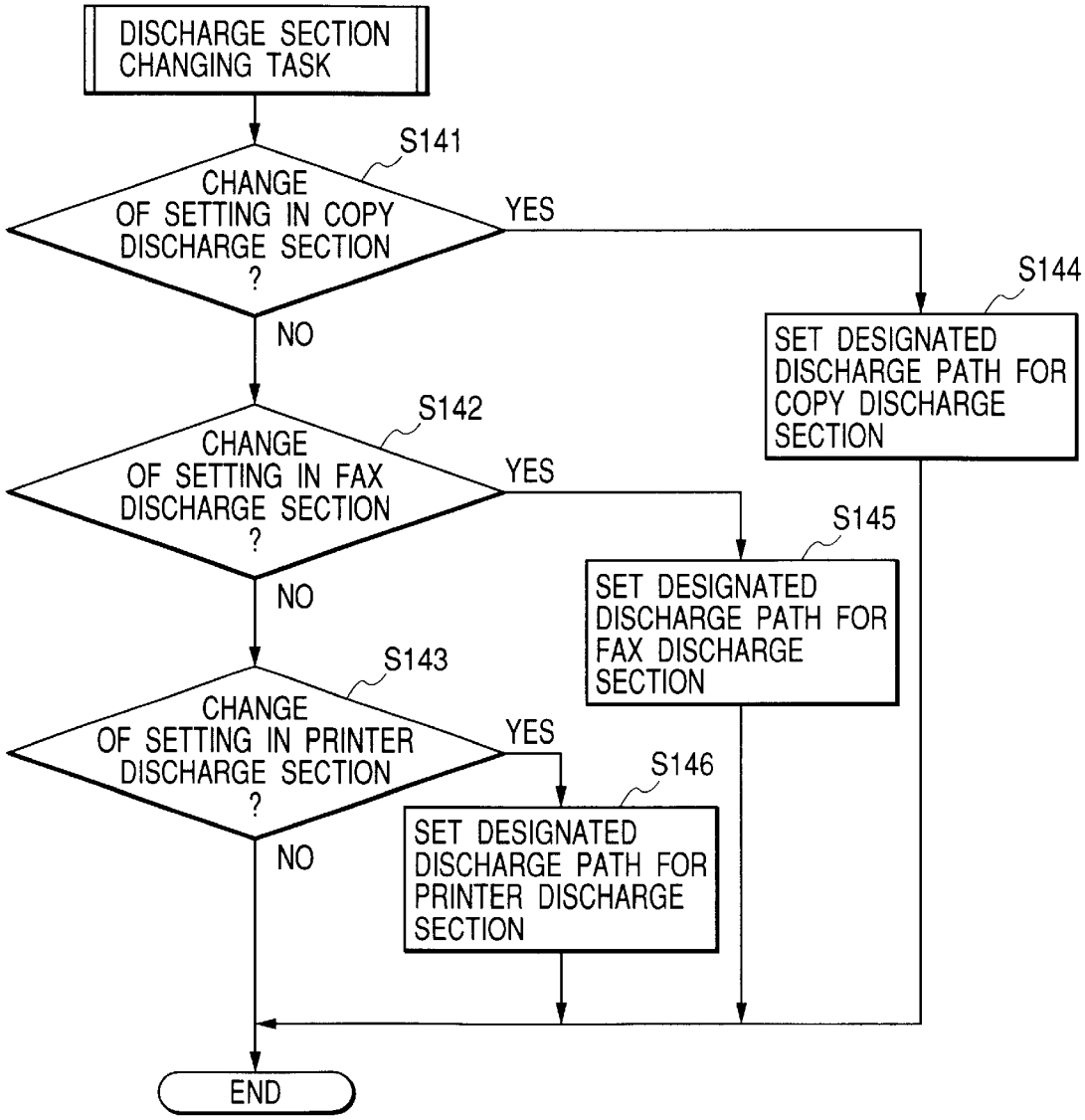
FIG. 8 is a flow chart of a discharge section changing task to be executed by the main CPU 101 shown in FIG. 2.

FIG. 8 shows a discharge section changing task, which is activated when the setting of the discharge path is changed by the operation panel 112 or from the PC terminal on the LAN.

At first there is discriminated whether the setting of the copy discharge section is changed (step S141), and, if changed, the designated discharge path is set as the discharge section for the copy (S144). Then there is discriminated whether the setting of the FAX discharge section is changed (S142), and, if changed, the designated discharge path is set as the discharge section for the facsimile (S145). Then there is discriminated whether the setting of the printer discharge path is changed (S143), and, if changed, the designated discharge path is set as the discharge port for the printer (S146). The discharge path designated in the above-described process is naturally any of the first to third discharge paths 22 to 24.

Thus, in case the apparatus is utilized for copy/FAX/printer according to the setting from the operation panel 112 or from the PC terminal on the LAN, the discharge paths to be employed in the recording processes of the copy/FAX/printer are respectively assigned to the first to third discharge paths 22 to 24.

FIG. 8 shows a case of changing the discharge ports for the copy/FAX/printer, but such example is not restrictive and it is also possible to execute such setting as to change the discharge port for each client terminal or for each job. For example there can be conceived such control as to execute the output of a printing designated from the client terminal or of a print job by a specified discharge port.

Figure 9:
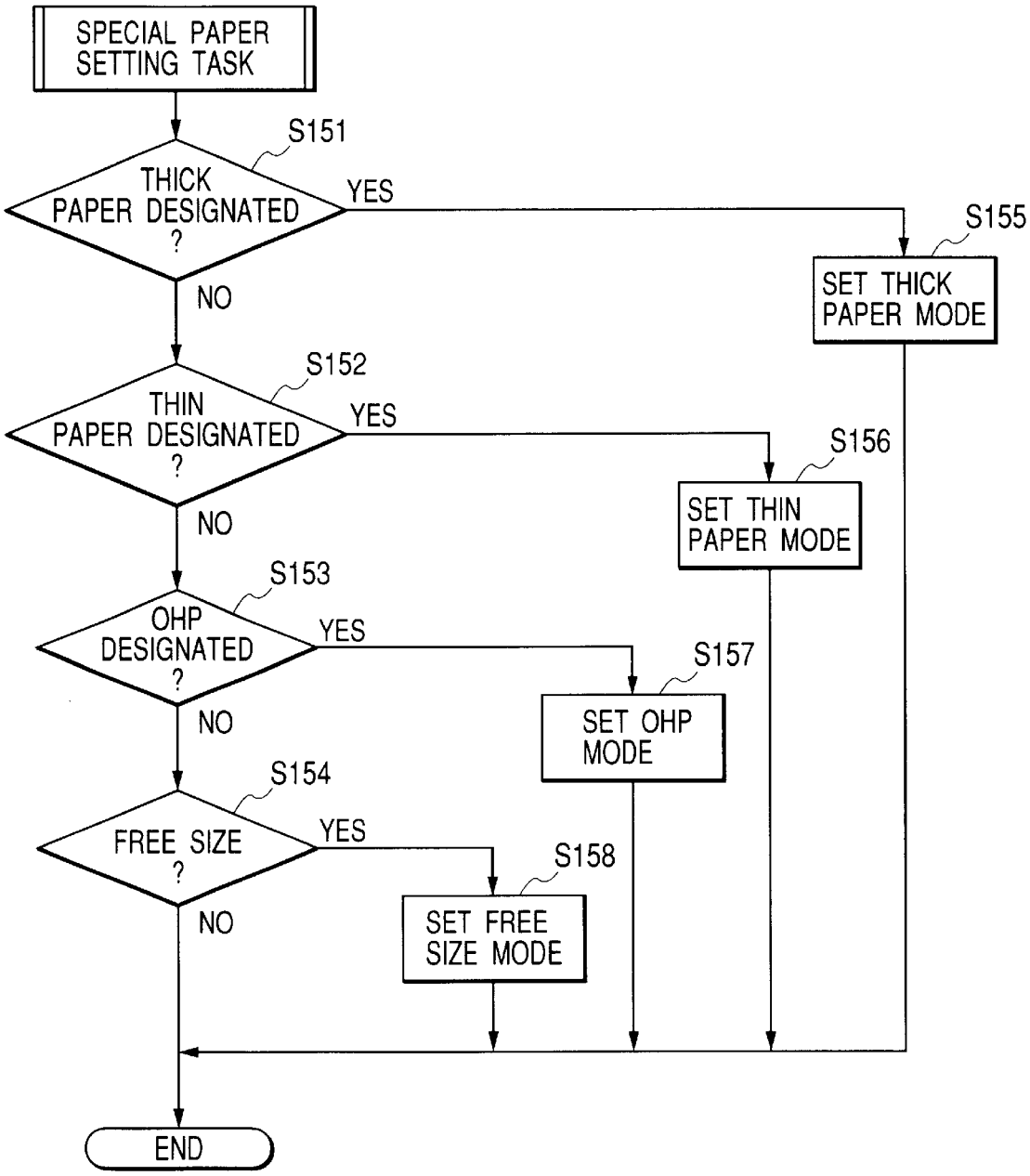
FIG. 9 is a flow chart of a special paper setting task to be executed by the main CPU 101 shown in FIG. 2.

FIG. 9 shows a special paper setting task, which is activated when the special paper is set by the operation panel 112 or by the PC terminal in the LAN. In this task, there is discriminated whether cardboard, thin paper, OHP sheet or free-size sheet is set (steps S151 to S154), and, if set, respectively corresponding special paper modes are set (S155 to S158) and such mode is set in the RAM 111 whereupon the present task is terminated.

In the following there will be explained the function of the electrophotographic recording unit 107, of which the MPU 201 functions according to a program stored in the ROM 203.

Figure 10:
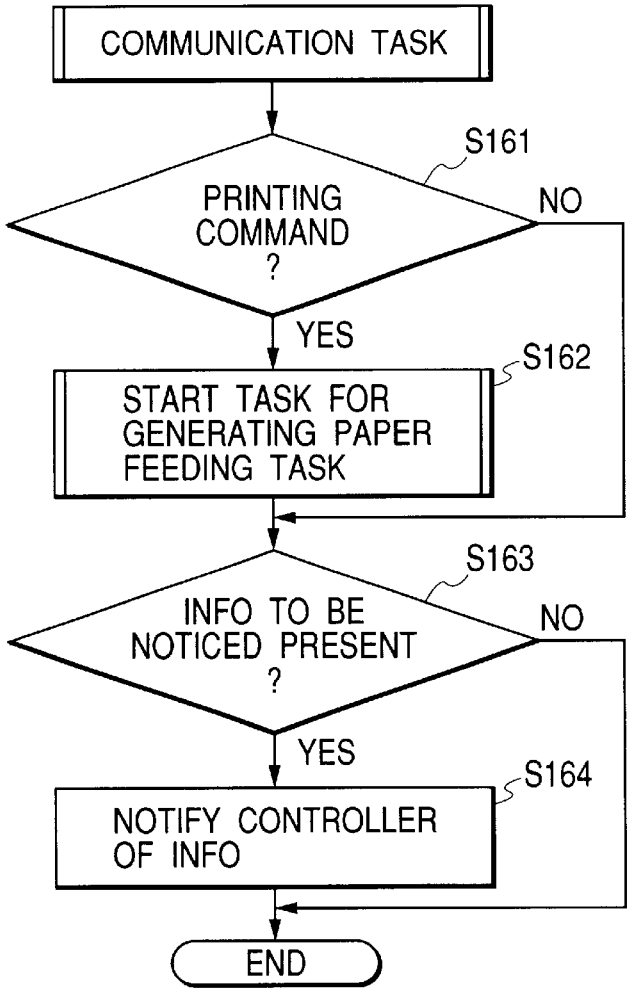
FIG. 10 is a flow chart of a communication task to be executed by an MPU 201 shown in FIG. 3.

FIG. 10 shows a communication task to be used for exchanging commands between the CPU 101 and the MPU 201 and informing the CPU 101 of the state information, etc. of the electrophotographic recording unit 107.

The MPU 201 discriminates whether there exists a print instruction command (generated by the print instruction command generating task shown in FIG. 7) from the CPU 101 (step S161).

When the print instruction command arrives from the CPU 101, the content of the command is temporarily stored in the RAM 202, and a paper feed task generating task is started (S162). The print instruction command contains not only the print instruction but also information indicating the resolution required for printing, recording sheet size, and designated sheet cassette stage, also information indicating dual-size recording or single-side recording as shown in FIG. 7 and information on the discharge port for the recording sheet.

Then there is discriminated whether there is information to be informed from the electrophotographic recording unit 107 to the CPU (controller) 101 (S163). If there is information to be informed to the CPU 101, such information is informed to the CPU 101 (S164) whereupon the present task is terminated. Such information to be informed to the CPU 101 includes information on the sheet jamming in various units, information on the connected finisher and information on the state thereof.

Figure 11:
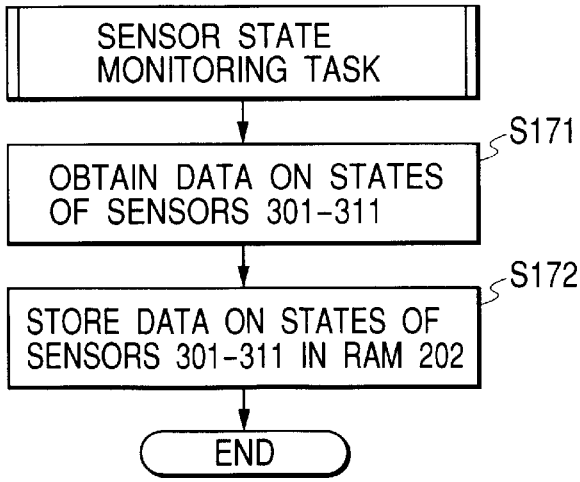
FIG. 11 is a flow chart of a sensor state monitoring task to be executed by the MPU 201 shown in FIG. 3.

FIG. 11 is a sensor state monitoring task of the MPU 201. The sensor state monitoring task is activated at every 2 msec for example by timer interruption, and acquires the on/off state information of the sensors 301 to 311 (information whether each sensor detects the sheet) (step S171) and stores the acquired sensor information in the RAM 202 (S172).

Figure 12:
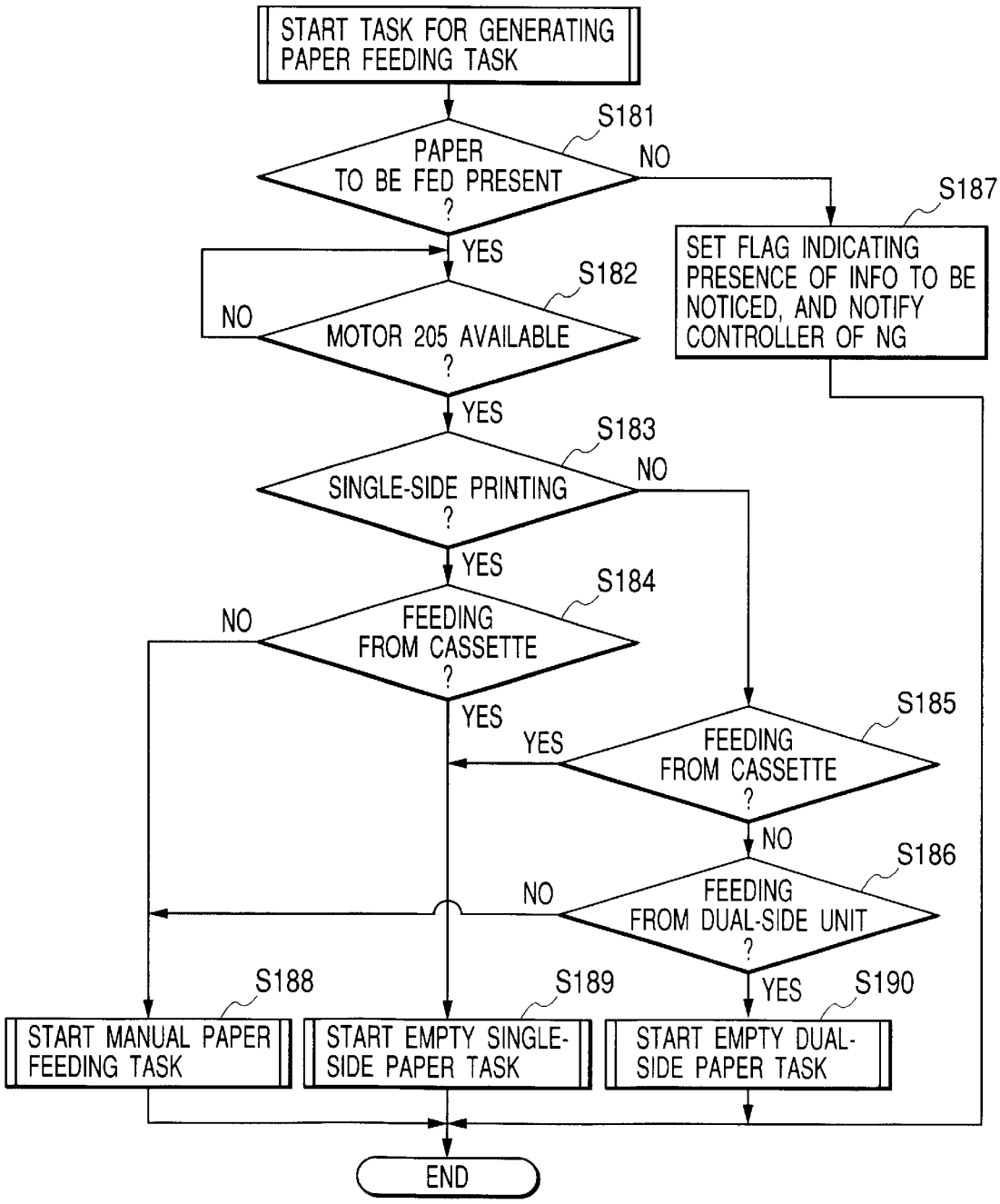
FIG. 12 is a flow chart of a task for a paper feeding task to be executed by the MPU 201 shown in FIG. 3.
Figure 13:
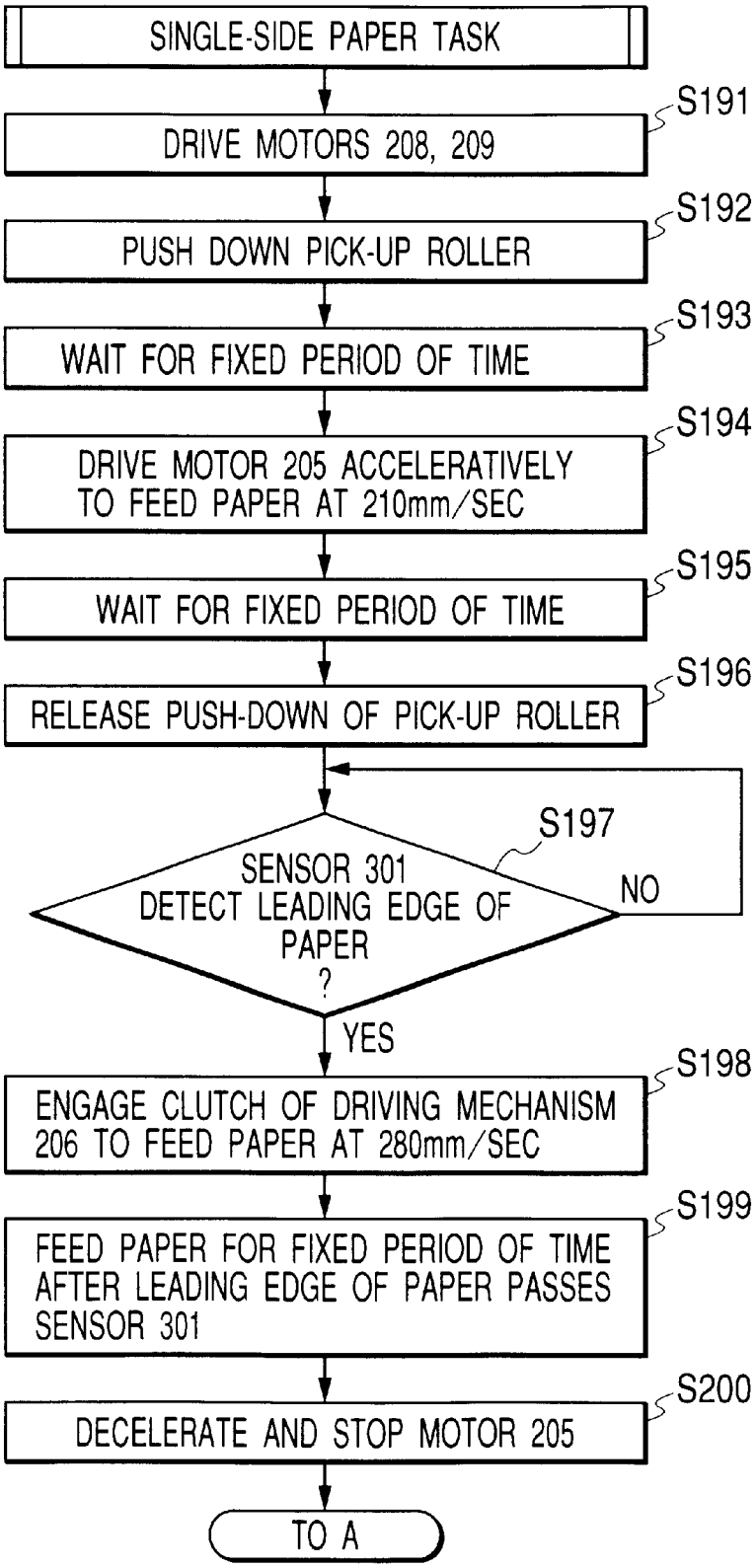
FIGS. 13, 14, 15 and 16 are flow charts of a single-side paper task to be executed by the MPU 201 shown in FIG. 3.

FIG. 12 shows the mode of activation of the task for generating the paper feed task. The MPU 201 discriminates whether the paper feed section such as a designated sheet cassette contains a feedable sheet (step S181). For such sheet detection, there are used unrepresented sensors provided in the positions of the cassettes 11 to 13. In the absence of paper, there is set a flag indicating the information is present (S187), and the communication task shown in FIG. 10 informs the CPU 101 of a fact that the print instruction command cannot be executed and the reason therefor, whereupon the present task is terminated.

On the other hand, in case the designated cassette contains the sheet, there is discriminated whether the motor 205 is being used (S182), and, if used, the sequence waits until the motor 205 reaches an unused state. In this manner there is checked whether the motor 205 for pickup up the sheet from the cassette and the sequence waits until the sheet pickup operation from the cassette is enabled.

If the motor 205 is available, there is discriminated whether the single-side printing is instructed (S183), and, if so, there is discriminated whether the sheet feeding is from the cassette (S184). If not, the sheet feeding is judged as from the manual sheet feed unit and a manual sheet feed task is activated (S188). Such manual sheet feed task is not related with the present invention and will not be explained further.

In case of sheet feeding from the cassette, there is activated an available single-side paper task (S189). The single-side paper task is present in plural units in order that the plural sheets of different feed timings can be simultaneously present in the apparatus. In this manner a next sheet can be fed before the discharge of the fed sheet is not yet completed, whereby the throughput of the apparatus can be improved.

On the other hand, in case the single-side printing is not instructed, there is discriminated whether the sheet feeding from the cassette is instructed (S185), and, if so, there is activated the aforementioned available single-side paper task (S189). In case the sheet feeding from the cassette is not instructed, there is discriminated whether the sheet feeding is from the dual-side unit 25 (S186), and, if not, the manual sheet feeding task is activated (S188). Also in case of sheet feeding from the dual-side unit, a dual-side paper task is activated (S190). The dual-side paper task, like the single-side paper task, is present in plural units in order that the plural sheets of different feed timings can be simultaneously present in the apparatus. In this manner a next sheet can be fed before the discharge of the fed sheet is not yet completed, whereby the throughput of the apparatus can be improved.

In the following there will be explained a single-side paper task controlled by the MPU 201, with reference to FIGS. 13 to 16. For the purpose of simplicity, the single-side paper task will be explained only in case of sheet feeding from the cassette 11.

When the single-side paper task is activated, power supply is initiated to the heater of the thermal fixation unit, etc. to activate the main motor 208 and the DC motor 209 (step S191). The motor 209 is so controlled as to convey the recording sheet at a speed of 140 mm/sec, which enables latent image formation, image transfer and thermal fixation in a stable manner.

Then the pickup roller 401 is rotated by the motor 205 and is pressed down by the driving force of the main motor 208, transmitted by an unrepresented clutch (S192). After the lapse of a predetermined time from the press-down operation of the pickup roller 401 (S193), the motor 205 (stepping motor) is activated, whereby the roller 401 starts to rotate under acceleration so as to convey the recording sheet at a speed of 210 mm/sec (faster than the speed of 140 mm/sec enabling the aforementioned latent image forming drum 18 to execute the recording operation), thereby picking up the recording sheet (S194). After the lapse of another predetermined time (S195), the pickup roller 401 is lifted (S196).

Then, when the sensor 301 detects the leading end of the sheet (S197), the clutch of the driving mechanism 206 is turned on to rotate the rollers 403, 404 by the driving force of the main motor 208 transmitted through the driving mechanism 206, so as to convey the sheet at a speed of 280 mm/sec (S198).

Then, after the lapse of a predetermined time, variable according to the sheet size, from the detection of the leading end of the sheet by the sensor 301 (S199), the motor 205 is decelerated and is then stopped (S200). This operation is to prevent erroneous conveying of a next sheet by the rotation of the rollers 402. In this manner there can be prevented a situation wherein the trailing end of a preceding sheet stops in a state caught in the rollers 402 and a next sheet is erroneously conveyed, and such sheet is conveyed by the rollers 403. Since the motor 205 is composed of a stepping motor, there is executed such control as to decelerate and then stop the motor 205 in order to reduce the noises, but there may also be employed a configuration of simply turning off a clutch or the like.

Then after the lapse of a predetermined time from the detection of the leading end of the sheet by the sensor 302 (a time required by the leading end of the sheet to reach a position of about 10 mm at the downstream side of the rollers 404) (steps S201, S202 in FIG. 14), the clutch of the driving mechanism 206 is once turned off in the presence of a preceding sheet, thereby stopping the drive for the rollers 403, 404 (S203, S204). The presence of the preceding sheet is discriminated by an unrepresented task, and the preceding sheet is judged absent or present respectively if the leading end of such preceding sheet is detected after the lapse of a predetermined time, determined by the sheet size, from the passing of the trailing end of the preceding sheet through the sensor 302 or if such detection of the leading end takes place before the lapse of such predetermined time. Such discrimination is made in order to adjust the sheet gap to the preceding sheet and to adjust the sheet registration. The sheet gap is variable according to the sheet size and is 36.5 mm in case of A4/letter size. In practice, such control can be achieved by stopping the drive of the rollers 403, 404 by the driving mechanism 206 (turning off the clutch for transmitting the power of the main motor 208) for a predetermined time determined by the size of the preceding sheet. After the lapse of the predetermined time (S205), the clutch of the driving mechanism 206 for transmitting the power of the main motor 208 is turned on to re-drive the rollers 403, 404 (S206).

On the other hand, in the absence of the preceding sheet, the aforementioned stopping control (S204 to S206) is not executed.

In succession, there is initiated the preparatory operation for the process-related sections such as the developing unit, transfer unit, fixing unit, etc. (S207). Then, for a predetermined time after the detection of the leading end of the sheet by the sensor 303, the front end of the sheet is made to impinge on the rollers 405 while the motor (stepping motor) 207 is stopped to control the amount of the loop thus formed, thereby achieving appropriate registration control (S208, S209).

Then the motor 207 is so accelerated as to convey the sheet with a speed of 280 mm/sec (S210). When the leading end of the sheet reaches a position of about 10 mm in front of the sensor 304, to be determined by the number of steps for driving the motor 207 (step S211 in FIG. 15), the stepping motor 207 enters a control of decelerating to a speed capable of conveying the sheet at a speed of 140 mm/sec (S212), because the process speed of image development, image transfer, image fixation, etc. is as low as 140 mm/sec.

When the deceleration is started, the clutch of the deriving mechanism 206 for transmitting the power of the main motor 208 is turned off to stop the rollers 403, 404 (S213). Such control is to avoid a situation where the sheet generates a large loop at the position of the rollers 405 by the speed difference between the motors 207 and 206, thus resulting in a Z-fold or a jamming in the sheet. In the foregoing, the clutch of the driving mechanism 206 is turned off, but such objective can also be attained by decelerating the motor 206 so as to obtain a sheet conveying speed same as or lower than the rotation of the rollers 405.

Then, when the leading end of the sheet is detected by the sensor 304 (S214), there is executed the timing of forming the latent image by the laser light recording and process-related control such as image development and image transfer (S215). In the present embodiment, there are executed the exposure by the laser unit 17, development of the latent image on the latent image forming drum 18, transfer by the transfer roller 19 and toner fixation by the thermal fixation rollers 20.

Then, when the trailing end of the sheet by the sensor 303 (S216), there is determined a timing for terminating the laser light emission (S217), and, after the detection of the trailing end of the sheet by the sensor 304 (S218), there is discriminated whether a succeeding sheet is present (S219) as will be explained later. The presence of the succeeding sheet is discriminated in an unrepresented task whether the succeeding sheet is in the course of feeding or whether a next print instruction is given from the CPU 101 when the trailing end of the sheet passes the sensor 304, and the succeeding sheet is judged absent or present respectively if both conditions are negated or if either of the conditions is affirmative. In the absence of the succeeding sheet (S219), the power supply to a high voltage section of the process unit is terminated (S220).

In the present embodiment, the sensor 304 is composed of a mechanical actuator, of which movement detects the presence or absence of the sheet. In such configuration, there is generated a time difference between the actual time of passing of the trailing end of the sheet and the detection of passing of the trailing end of the sheet. For this reason, the sensor 304 is not used for controlling the timing for terminating the laser light emission.

In case the step S219 identifies the presence of a succeeding sheet, the sequence proceeds to a next step (S221 in FIG. 16) without terminating the power supply to the high voltage section of the process unit.

Then, when a predetermined time lapses after the detection of the leading end of the sheet by the sensor 305 (S221, S222 in FIG. 16), the motor 210 is driven so as to convey the sheet with a speed of 140 mm/sec (S223).

Then, there is discriminated whether the setting information for the discharge port, designated by the print instruction command from the CPU 101, is changed (S224), and, if the discharge port is changed, there is set changing information for the discharge port (S225). The change of the discharge port information is executed by a discharge port information changing task shown in FIG. 22 (to be explained later).

There is discriminated whether the discharge path of the rollers 411 (first discharge port 22), the discharge path of the rollers 412 (second discharge port 23), the discharge path of the rollers 413 (third discharge port 24) or the dual-side path 25 is selected as the set discharge port (S226, S227, S228), and the discharge port is selected according to such discrimination. Thus, the first discharge task is activated in case of discharge to the first discharge port (S229), the second discharge task is activated in case of discharge to the second discharge port (S230), the third discharge task is activated in case of discharge to the third discharge port (S231), and the dual-side path task is activated in case of guiding the sheet to the dual-side path (S232).

Figure 17:
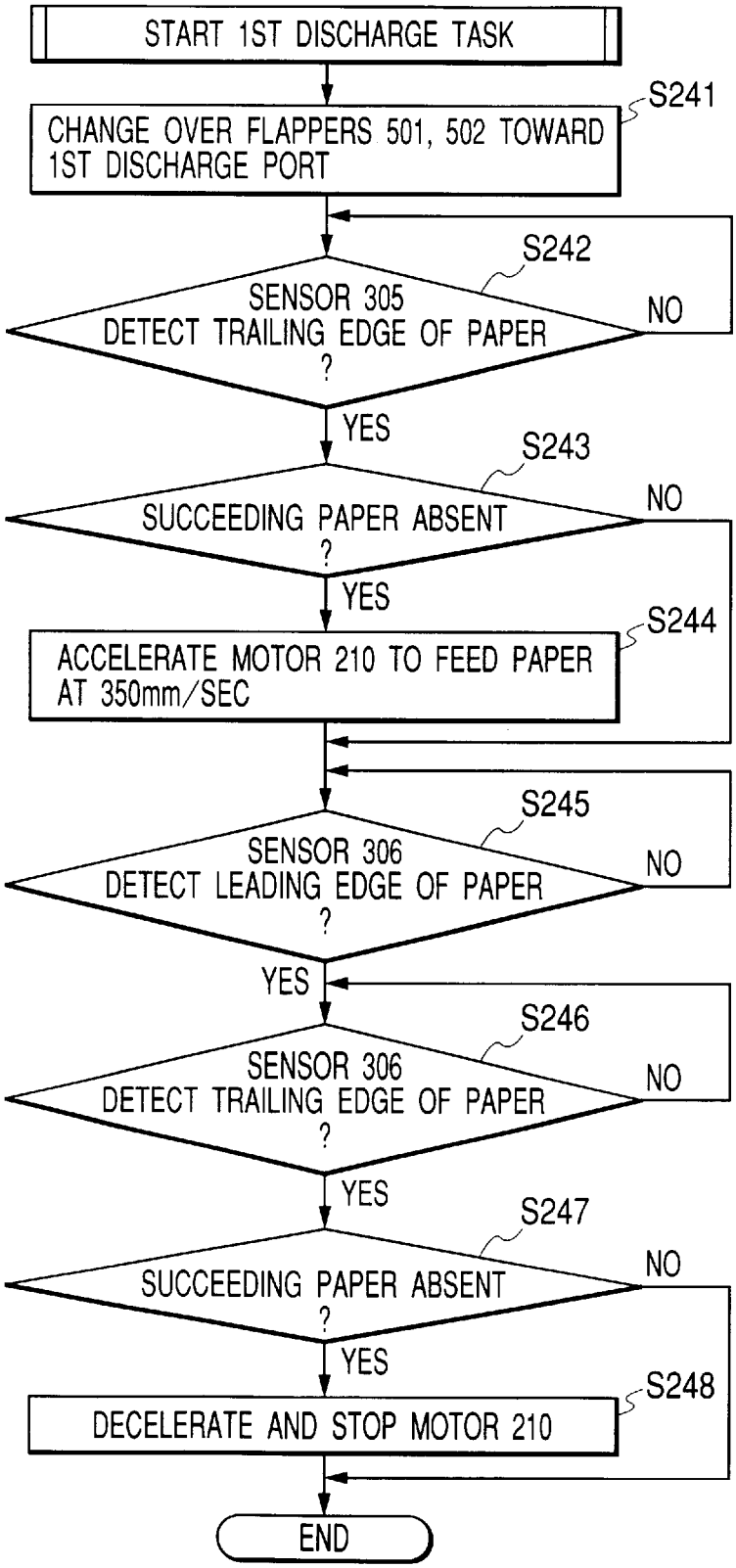
FIG. 17 is a flow chart of a first discharge task to be executed by the MPU 201 shown in FIG. 3.

FIG. 17 shows the above-mentioned first discharge task. When the first discharge task is activated, the flappers 501, 502 are switched in a direction toward the first discharge port 22 (S241). The flappers are switched, in case the discharge path is changed between a preceding sheet and the present sheet, in such a manner that the respective flapper is switched at a timing when the trailing end of the preceding sheet passes through such flapper, to be determined by the number of steps after the passing of the trailing end of the preceding sheet through the sensor 305.

Then, when the sensor 305 detects the passing of the trailing end of the sheet (S242), and, in the absence of the succeeding sheet according to the aforementioned discrimination (S243), the acceleration control of the motor 210 is started at a timing when the trailing end of the sheet is disengaged from the rollers 409. The stepping motor 210 executes acceleration control from the process speed of 140 mm/sec to a speed of 350 mm/sec (S244). Such acceleration is made in order to reduce the first copy time (staying time of the sheet in the apparatus).

On the other hand, in the absence of the succeeding sheet, the motor 210 does not execute acceleration but continues the conveying operation at 140 mm/sec. In the presence of the succeeding sheet, the acceleration to 350 mm/sec is not executed in order to improve the stacking property of the sheets after discharge. Stated differently, if the sheets are discharged in succession at a speed of 350 mm/sec, the discharged sheets are stacked on the tray in a distorted manner because of the high discharging speed.

The presence of the succeeding sheet is discriminated, as explained in the foregoing, in an unrepresented task whether the succeeding sheet is in the course of feeding or whether a next print instruction is given from the CPU 101 when the trailing end of the sheet passes the sensor 304, and the succeeding sheet is judged absent or present respectively if both conditions are negated or if either of the conditions is affirmative.

The rollers 411 of the discharge path (first discharge port 22) are driven by the motor 210, same as that for the rollers 410, and discharge the conveyed sheet to the exterior of the apparatus. In this operation, the sensor 306 detects the leading end of the sheet (S245) and then the trailing end thereof (S246), whereupon, in the absence of the succeeding sheet (S247), the motor 210 is decelerated and stopped (S248).

As explained in the foregoing, in case special paper such as cardboard, thin paper, OHP sheet or free-size sheet is selected as the sheet, the CPU 101 generates such print instruction command as to execute the discharge from the first discharge port 22, namely the discharge path of the rollers 411, regardless of the setting of the discharge port.

This is because the discharge path of the rollers 411 (first discharge port) has a smaller curvature in the discharge path than in the discharge path of the rollers 412 (second discharge port) or that of the rollers 413 (third discharge port) and is the shortest sheet discharge path, thereby decreasing the stress given to the sheet. Also such configuration allows to limit the height of the apparatus and to improve the convenience of use of the apparatus (original handing on the original table 2 and operability of the operation unit). Also the configuration of placing the dual-side path 25 under the latent image forming drum 18, the transfer roller 19 and the thermal fixation rollers 20 allows to meet the strict requirement in the height of the apparatus.

In the present embodiment, the special paper is discharged from the first discharge path because of the smallest curvature thereof, but a same effect can naturally be obtained by selecting any discharge path having a small curvature.

Figure 18:
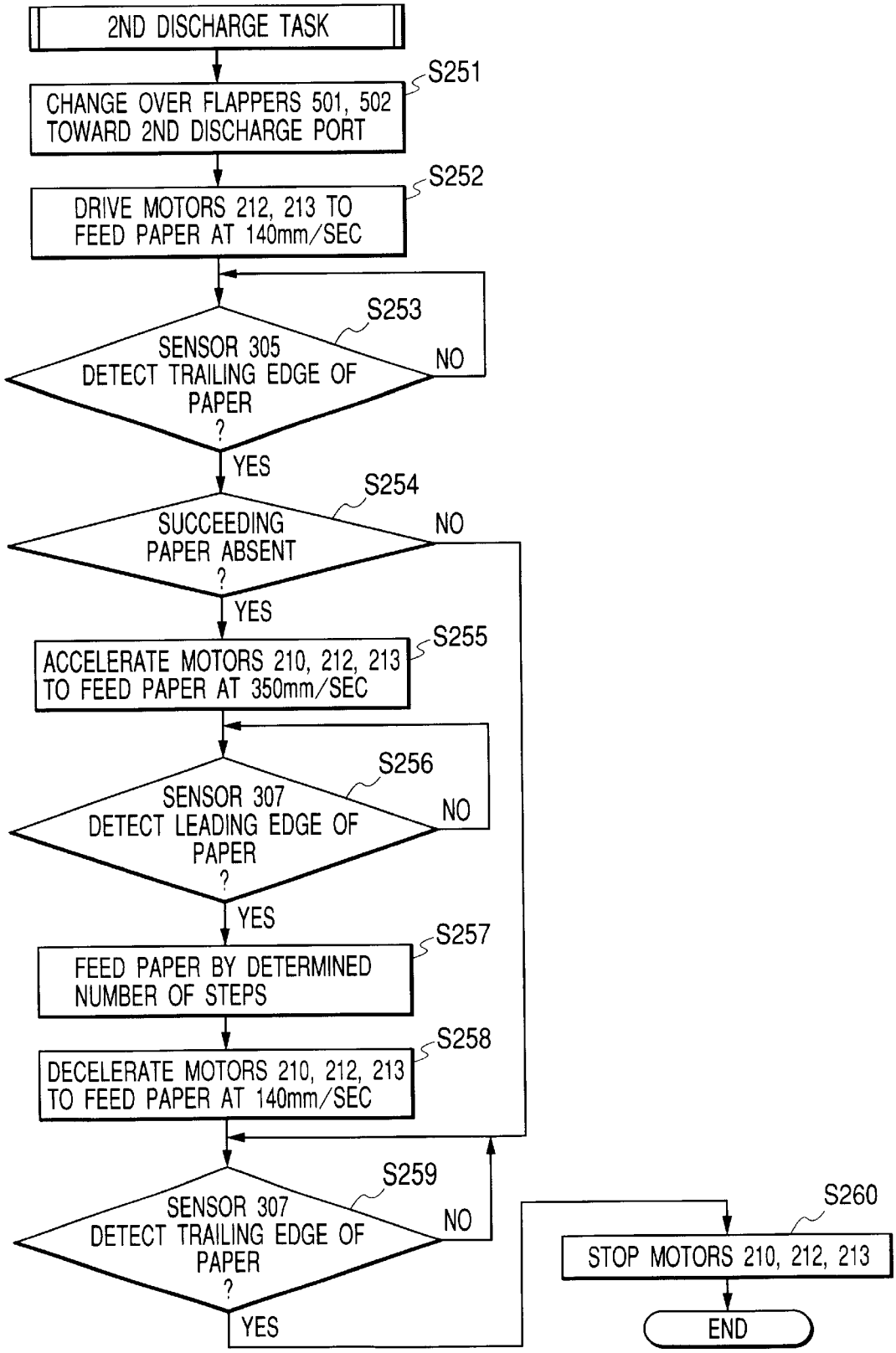
FIG. 18 is a flow chart of a second discharge task to be executed by the MPU 201 shown in FIG. 3.

FIG. 18 shows the second discharge task. When the second discharge task is activated, the flappers 501, 502 are switched in a direction toward the second discharge port (step S251). The flappers are switched in such a manner that the respective flapper is switched at a timing when the trailing end of the preceding sheet passes through such flapper, to be determined by the number of steps after the passing of the trailing end of the preceding sheet through the sensor 305.

Then the motors 212, 213 are driven at a speed of 140 mm/sec (S252), and, when the sensor 305 detects the passing of the trailing end of the sheet (S253), in the absence of the succeeding sheet as explained in the foregoing (S254), the acceleration control of the motors 210, 212, 213 is started at a timing when the trailing end of the sheet is disengaged from the rollers 409 (S255). These three motors are accelerated simultaneously in order to prevent bending or breakage of a large-sized sheet such as of A3 or B4 size as the rollers driven by such motors engage with such large-sized sheet. In a step S255, the motors 210, 212, 213 are accelerated from the process speed of 140 mm/sec to a speed of 350 mm/sec. Such acceleration is made in order to reduce the first copy time (staying time of the sheet in the apparatus). On the other hand, in the absence of the succeeding sheet, the stepping motor 210 is not accelerated but continues the conveying operation at 140 mm/sec.

Then, after passing of the leading end of the sheet through the sensor 307 (S256), the sheet is conveyed by a number of steps determined by the sheet size (S257) and the motors 210, 212, 213 are decelerated to 140 mm/sec (S258) thereby discharging the sheet from the second discharge port 23. The sheet is decelerated in the vicinity of the discharge port in case of sheet discharge from the second discharge port positioned above the first discharge port 22, because the stacking property of the sheets after discharge tends to be deteriorated in comparison with the sheet discharge from the first discharge port since the conveying path has a larger curvature (stronger curving) in the vicinity of the discharge port. Then, upon passing of the trailing end of the sheet through the sensor 307 (S259) and in the absence of the succeeding sheet, the motors 210, 212, 213 are stopped (S260).

Figure 19:
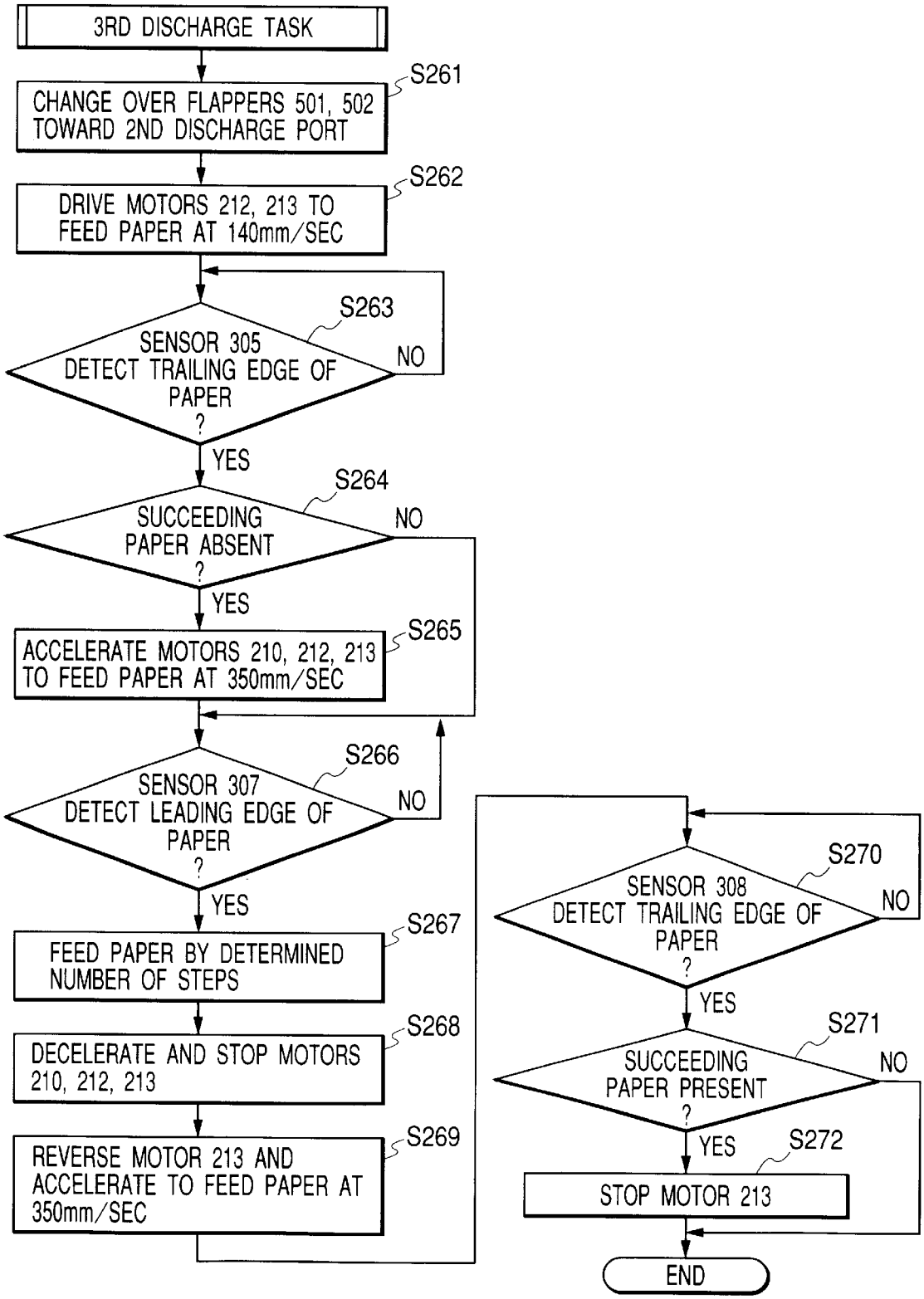
FIG. 19 is a flow chart of a third discharge task to be executed by the MPU 201 shown in FIG. 3.

FIG. 19 shows the third discharge task. When the third discharge task is activated, the flappers 501, 502 are switched in a direction toward the second discharge port (S261). The timing of flapper switching is same as explained before.

Then the motors 212, 213 are driven at a speed of 140 mm/sec (S262), and, when the sensor 305 detects the passing of the trailing end of the sheet (S263), in the absence of the succeeding sheet as explained in the foregoing (S264), the acceleration control of the motors 210, 212, 213 is started at a timing when the trailing end of the sheet is disengaged from the rollers 409 (S265). These three motors are accelerated simultaneously in order to prevent bending or breakage of a large-sized sheet such as of A3 or B4 size as the rollers driven by such motors engage with such large-sized sheet. In a step S265, the motors 210, 212, 213 are accelerated from the process speed of 140 mm/sec to a speed of 350 mm/sec. Such acceleration is made in order to reduce the first copy time (staying time of the sheet in the apparatus). On the other hand, in the absence of the succeeding sheet, the speed of the stepping motor 210 is not changed.

Then, after passing of the leading end of the sheet through the sensor 307 (S266), the sheet is conveyed by a number of steps determined by the sheet size to a position where the trailing end of the sheet is caught by the rollers 412 (S267) and then the motors 210, 212, 213 are decelerated and stopped (S268).

Then the flapper 503 is so switched that the sheet does not move backward to the upstream side of the conveying path, and the motor 213 is driven in the reverse direction (S269). After the activation in the reverse direction, the motor 213 is accelerated to 350 mm/sec. Such acceleration is made in order to reduce the first copy time (staying time of the sheet in the apparatus).

Then the sensor 308 detects the passing of the trailing end of the sheet (S270), and, in the absence of the succeeding sheet (S271), the motor 213 is stopped (S272).

As explained in the foregoing, the large-sized finisher 27 capable of Z-folding, book binding, etc. can be mounted on the third discharge port. Therefore, in case the function such as Z-folding or book binding is designated, the CPU 101 designates the third discharge path by the print instruction command regardless of the setting of the discharge port. Also such configuration allows to limit the height of the apparatus and to improve the convenience of use of the apparatus (original handing on the original table 2 and operability of the operation unit). Also the configuration of placing the dual-side path 25 under the latent image forming drum 18, the transfer roller 19 and the thermal fixation rollers 20 allows to meet the strict requirement in the height of the apparatus. Also in case the large-sized finisher 27 capable of Z-folding, book binding, etc. is mounted on the third discharge port and a jam is generated in such finisher, the CPU 101 executes sheet discharge through another discharge port regardless of the setting of the discharge path, as long as the first and second discharge ports are free from abnormality and the function of the large-sized finisher such as Z-folding or book binding is not utilized. This is also adopted in case a jam is generated in the second discharge port.

In the first, second or third discharge task shown in FIGS. 17 to 19, there is discriminated the presence or absence of the succeeding sheet (S243, S254, S264) and the motors (210 to 212, 213) are driven at the high speed of 350 mm/sec only in case of the absence of the succeeding sheet. In this manner it is rendered possible to further shorten the staying time of the sheet in the apparatus, thereby significantly improving the throughput of the image forming process. Such acceleration is executed only in the absence of the succeeding sheet, so that there can be avoided misalignment of the sheets on the tray after discharge or a failure in the post-processing such as book binding or folding.

Figure 20:
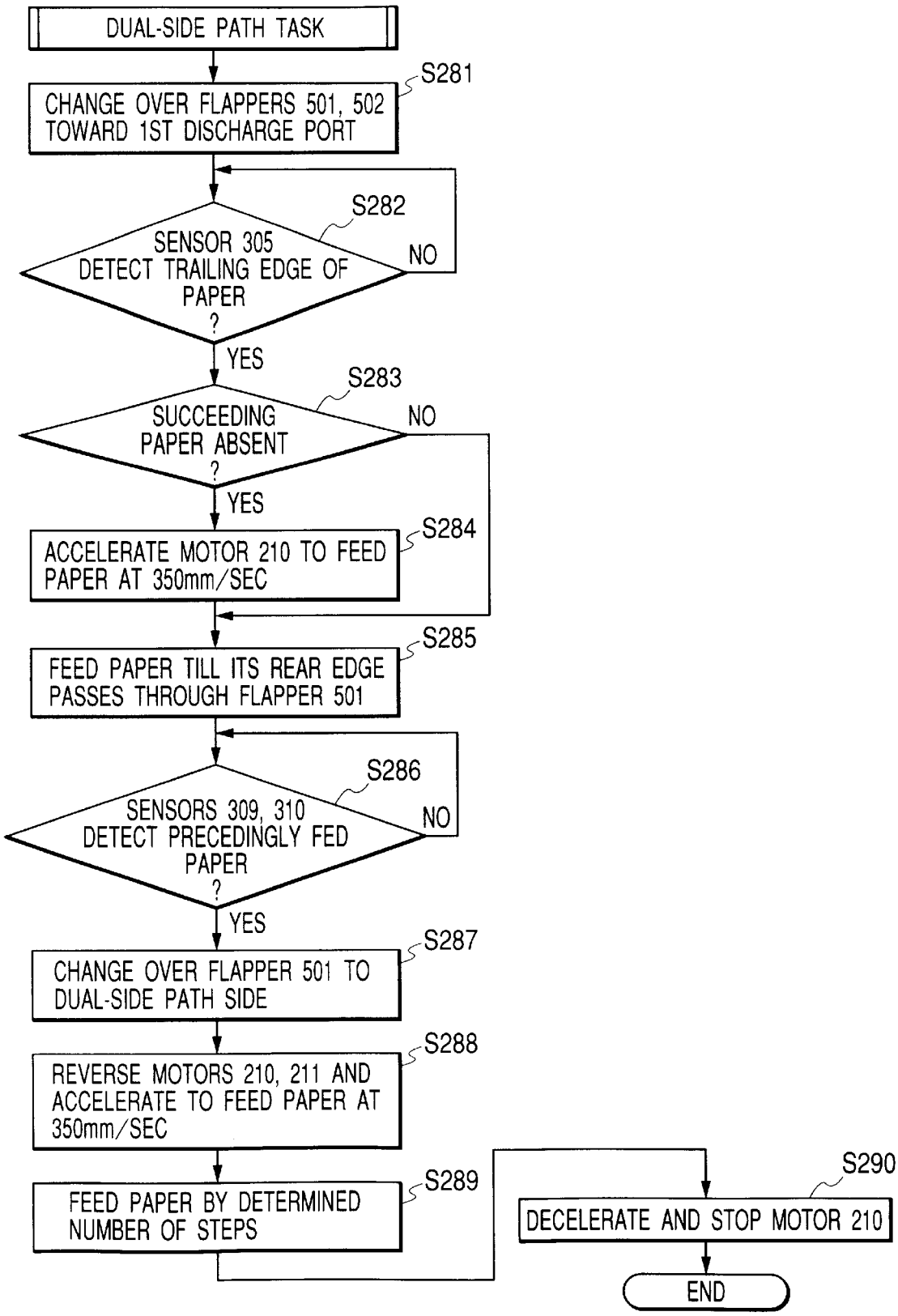
FIG. 20 is a flow chart of a dual-side path task to be executed by the MPU 201 shown in FIG. 3.

FIG. 20 shows a dual-side path task for inverting the sheet after recording on a side, for conveying into the dual-side unit.

When the dual-side path task is activated, the flappers 501, 502 are switched to the first discharge port (step S281), at a timing explained in the foregoing.

Then, when the trailing end of the sheet passes the sensor 305 (S282), the motor 210 conveys the sheet at the process speed in the presence of the succeeding sheet (S283) or with acceleration to 350 mm/sec in the absence of the succeeding sheet (S284). It is then stopped after conveying the sheet, after passing the sensor 305, by a number of steps determined by the sheet size and corresponding to a position where the trailing end of the sheet passes through the flapper 501 (S285).

Then the sensors 309, 310 are used to discriminate whether a preceding sheet is present in the dual-side path (S286), and the flapper 501 is switched to the dual-side path under the condition that the preceding sheet is absent (S287). Also the stepping motors 210, 211 are reversed and accelerate the rollers 410, 415, 416, 417 to 350 mm/sec (S288). Also in case of discrimination that the preceding sheet is present, the reversing of the motor 210 is started after waiting until the sensors 309, 310 discriminate that the preceding sheet is absent.

Then, after the passing of the leading end of the sheet through the sensor 310, the sheet is conveyed by a predetermined number of steps (S289), and the motor 211 is decelerated and stopped when the sheet is conveyed to the vicinity of the upstream side, in the conveying direction, of the jointing point of the conveying path 14 and the dual-side path 25 (S290) whereupon the present task is terminated. In this operation, the sheet is not stopped at the position of the sensor 310 but is conveyed to the vicinity of the jointing point at the downstream side in the sheet conveying direction, in order not to cause collision with the sheet fed from the sheet cassette and to reduce the gap to the preceding sheet as far as possible. The sheet discharging speed from the first or third discharge port is 350 mm/sec while the sheet conveying speed to a position in front of the latent image forming drum 18 (position of the rollers 405) is 280 mm/sec, in order to avoid damage to the sheet by rapid deceleration in case of deceleration of the sheet conveying speed in such position and to minimize the staying time of the sheet in the apparatus.

Figure 21:
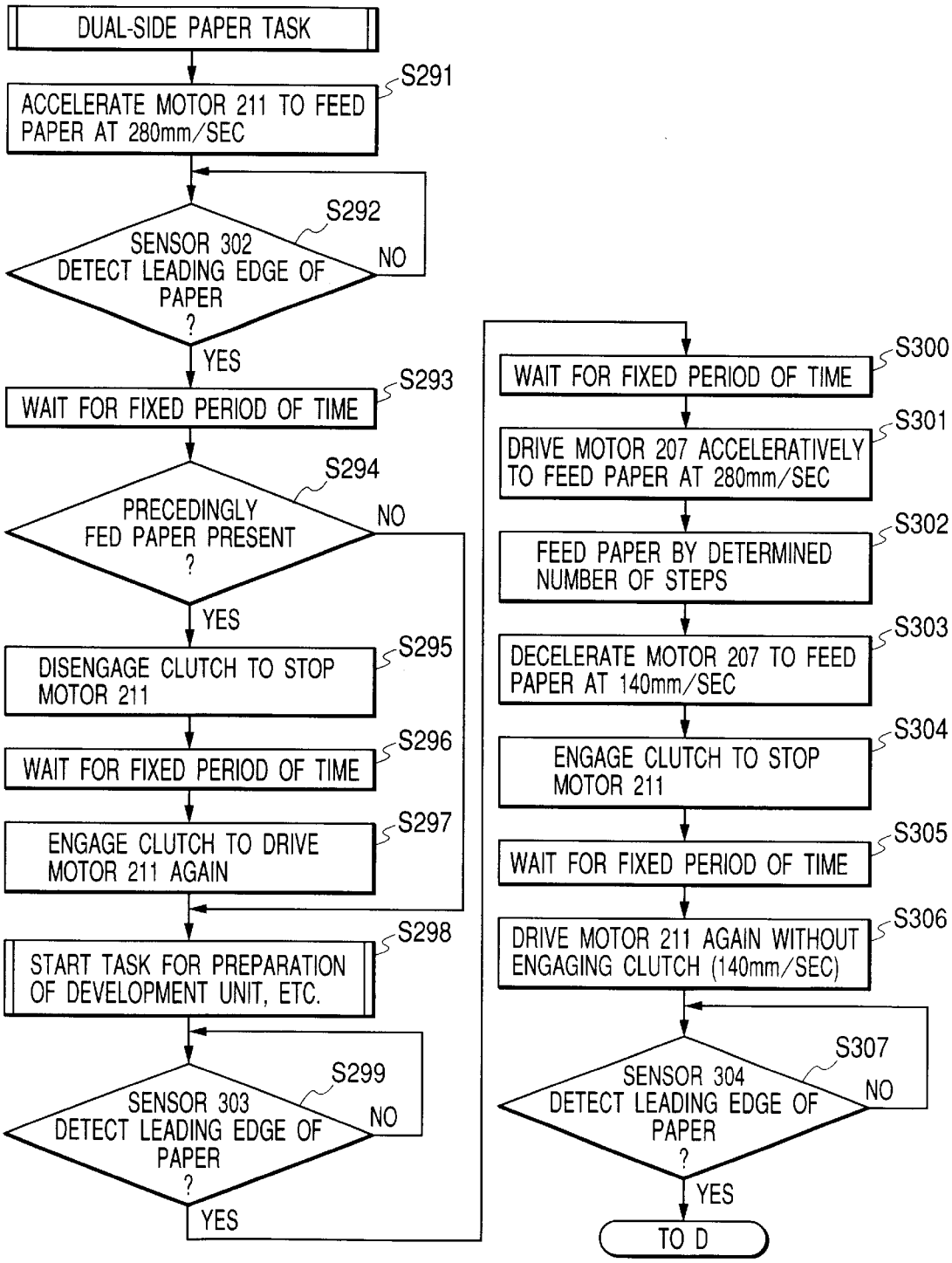
FIG. 21 is a flow chart of a dual-side paper task to be executed by the MPU 201 shown in FIG. 3.

FIG. 21 shows the dual-side paper task, which is to convey again (re-feed) the sheet, conveyed into the dual-side unit by the dual-side path task shown in FIG. 20, into the rollers 404, 405, . . . from the dual-side unit.

In the dual-side paper task shown in FIG. 21, if a print instruction command for recording on the rear side of the sheet from the CPU 101, the motor 211 conveys the sheet with acceleration to 210 mm/sec (step S291).

Then, the sensor 302 detects the leading end of the sheet (S292), and, after the lapse of a predetermined time (required by the leading end of the sheet to reach a position of about 10 mm at the downstream side of the sensor 404) (S293), there is discriminated whether a preceding sheet is present (S294).

The discrimination of the presence/absence of the preceding sheet is executed in the same manner as in the single-side paper task. In the presence of the preceding sheet, the clutch for transmitting the power from the main motor 208 is once turned off and the drive of the motor 211 is stopped (S295). Then, after the lapse of a predetermined time (S296), the clutch for transmitting the power from the main motor 208 is turned on and the motor 211 is re-activated (S297). In the absence of the preceding sheet, the stopping control of the steps S295 to S297 is not executed.

Then, there is initiated the preparatory operation for the process-related sections such as the developing unit, transfer unit, fixing unit, etc. (S298). Then, after the detection of the leading end of the sheet by the sensor 303 (S299), the front end of the sheet is made to impinge on the rollers 405 for a predetermined time determined by the sheet size (S300) to control the amount of the loop thus formed, thereby achieving appropriate registration control.

Then the motor (stepping motor) 207 is driven under acceleration to convey the sheet at a speed of 280 mm/sec (S301). When the leading end of the sheet reaches a position, determined by the number of steps of the motor 207 and corresponding to about 10 mm in front of the sensor 304 (S302), the motor 207 is decelerated to a speed capable of conveying the sheet at a speed of 140 mm/sec (S303).

Then, simultaneous with the start of deceleration of the motor 207, the clutch of the driving mechanism 206 is turned off and the motor 211 is decelerated and stopped (S304). Then, after the motor 211 is stopped for about 50 msec (S305), the motor 211 is re-activated in a state where the clutch of the driving mechanism 206 remains turned off so that the rollers 403, 404 can freely rotate (S306). The re-activation of the motor 211 is continued until the trailing end of the sheet passes through the position of the sensor 310. The motor 211 is stopped for about 50 msec because a loop will be formed in the sheet if the rollers 417 are decelerated while they still engage with the trailing end portion of a long sheet such as of A3 size. Also, the motor 211 is activated again immediately thereafter in order to push the sheet by the rollers 417, since the rollers 405 alone cannot provide a sufficient conveying force for a long sheet.

Figure 14:
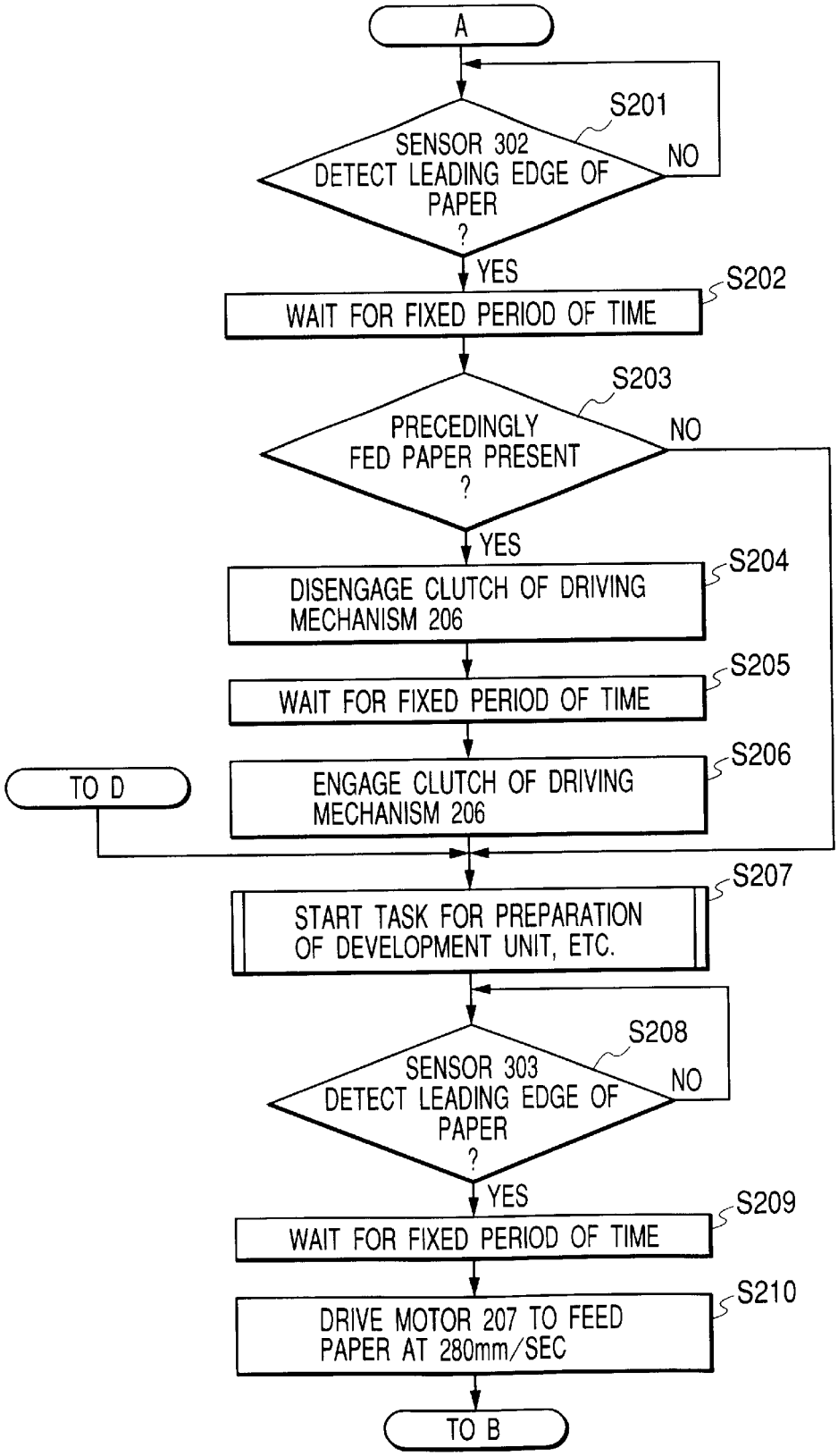
Figure 15:
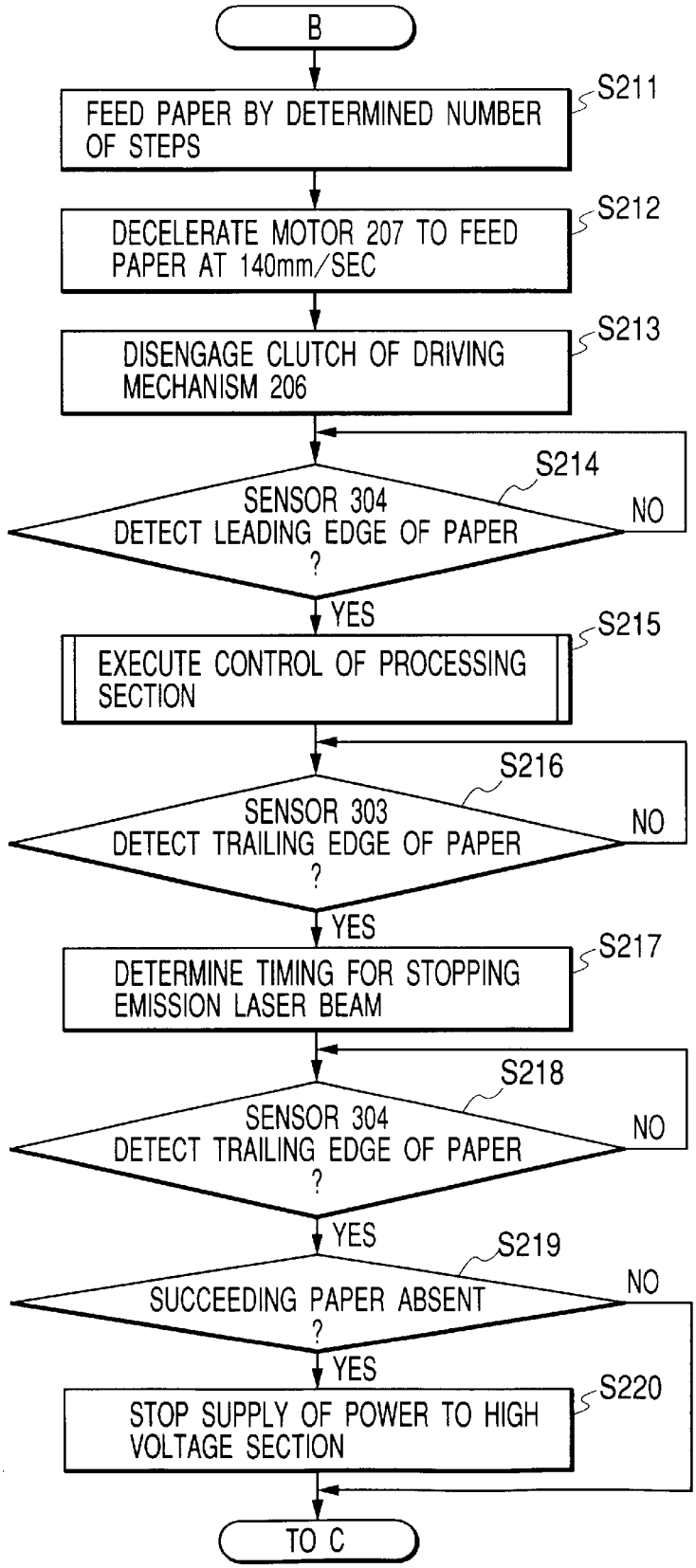
Figure 16:
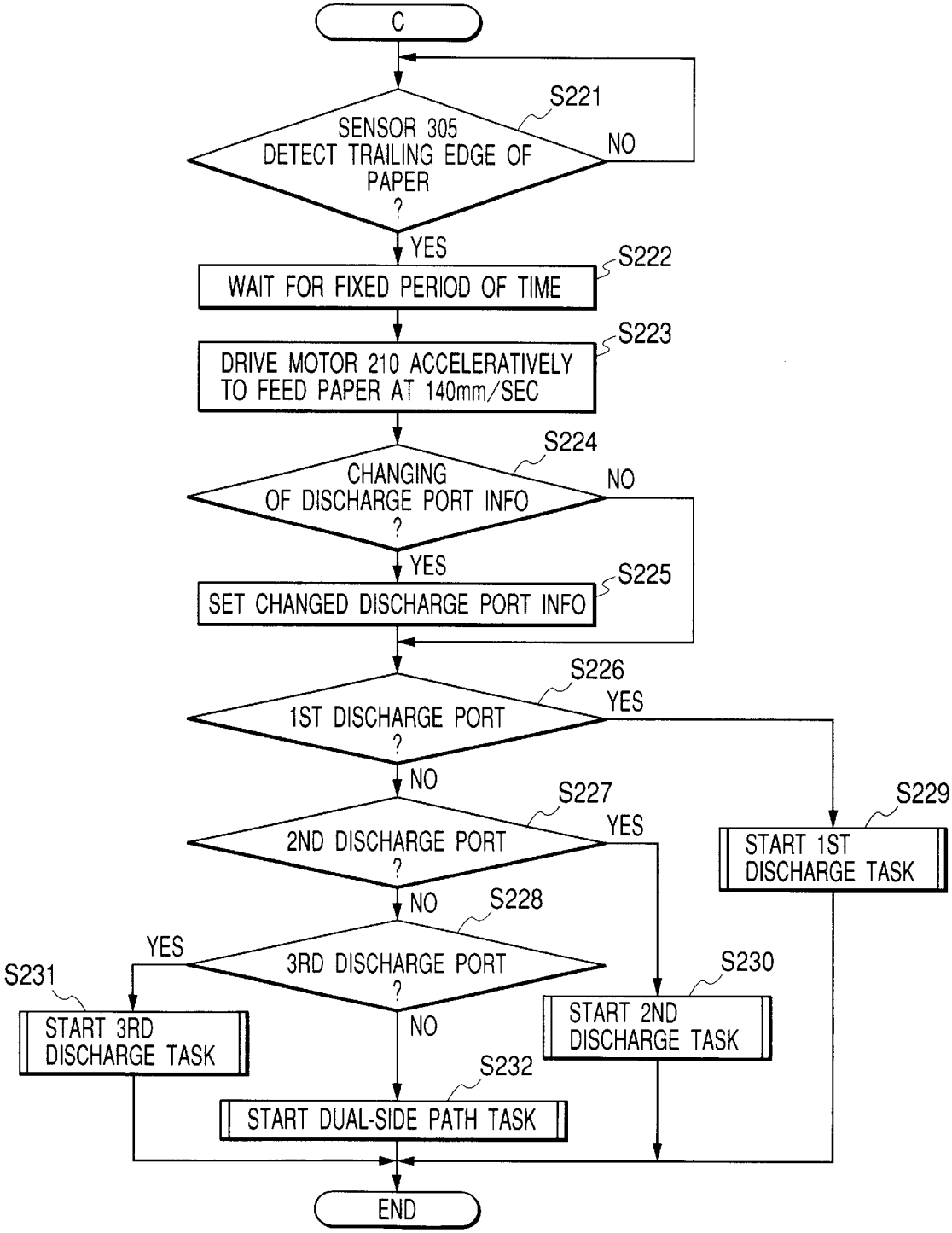

After the step S307, there is executed a process same as the process D in the single-side paper task (step S207 and the ensuing steps in FIG. 14). The process is so illustrated, for the purpose of simplicity, as if it jumps to the position D in the single-side paper task, but, in practice, the process does not jump but is executed in the same manner in another task.

In the task shown in FIG. 21, the control of turning off the clutch of the driving mechanism 206 and decelerating and stopping the motor 211 simultaneous with the start of deceleration of the motor 207(S304), then stopping the motor 211 for about 50 msec (S305), and reactivating the motor 211 in a state where the clutch of the driving mechanism 206 remains turned off so that the rollers 403, 404 can freely rotate (S306) allows to appropriately re-feed the sheet without forming a loop even in a long sheet which may simultaneously engage with the rollers 417 and 405, thus without jamming, deformation or breakage of the sheet or without deterioration in the recorded image quality, and also without deficiency in the conveying power.

Figure 22:
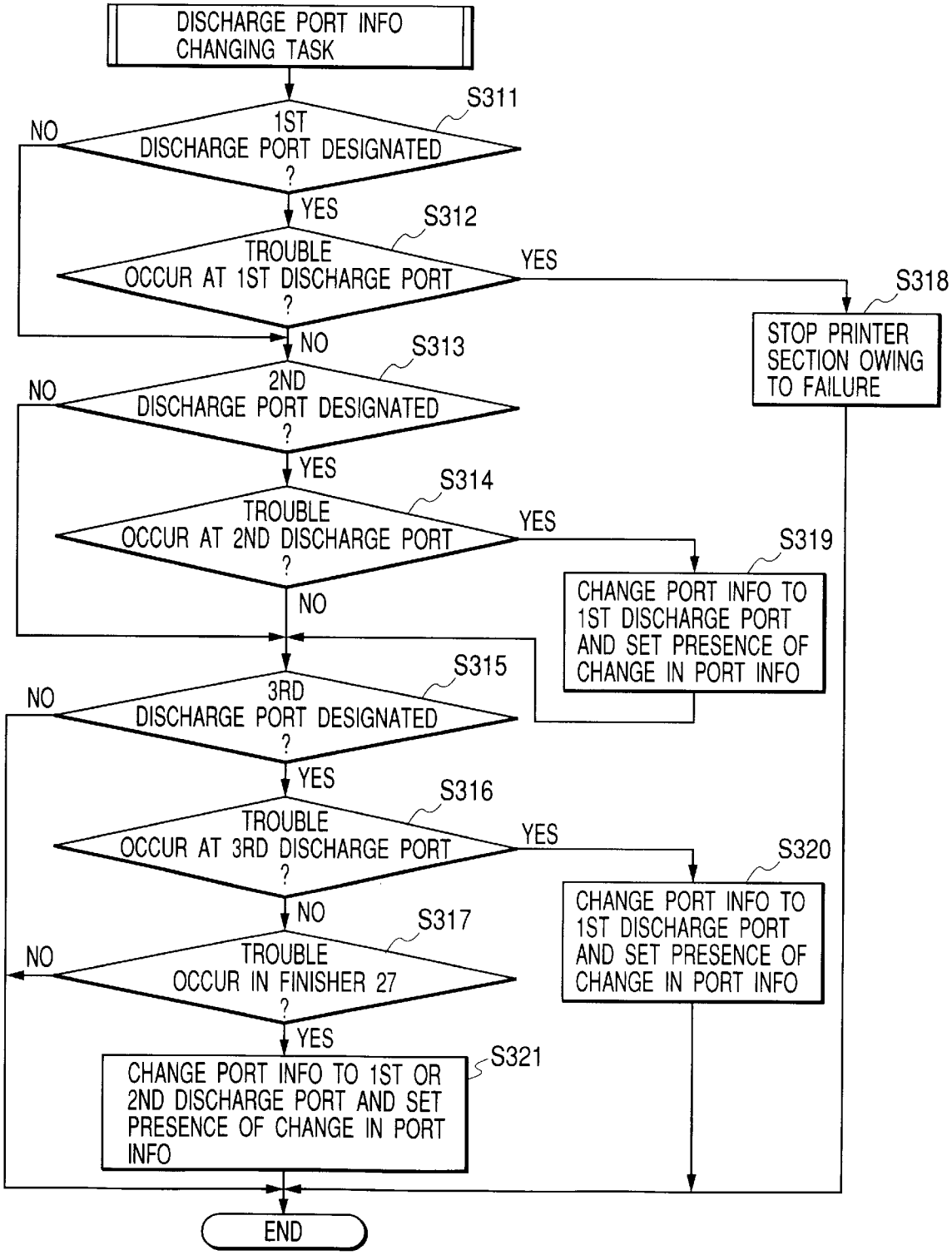
FIG. 22 is a flow chart of a discharge port information changing task to be executed by the MPU 201 shown in FIG. 3.

FIG. 22 shows the discharge port information changing task, which is to change the discharge port according to an abnormality in the discharge port designated by the print instruction command and periodically monitors the abnormality in the discharge port.

When the discharge port information changing task is activated, the MPU 201 discriminates whether the first discharge port 22 is designated as the discharge port (step S311). If designated, there is discriminated, based on the information from the sensor 306 and the finisher 26, whether the first discharge port 22 is in an abnormal state for example by paper jamming (S312). If the first discharge port 22 is in an abnormal state, the function of the printer unit is terminated as a printer abnormality for example by paper jamming (S318). The function of the printer unit is terminated because the abnormality in the first discharge port, being in the most upstream position, may possibly clog the conveying paths to other discharge ports.

In case the first discharge port is not designated or in case the first discharge port is not in an abnormal state, there is discriminated whether the second discharge port 23 is designated (S313). If designated, there is discriminated, based on the information from the sensor 307 and the finisher 26, whether the second discharge port 23 is in an abnormal state for example by paper jamming (S314). If the second discharge port 23 is in an abnormal state, and if the discharge to the first discharge port is possible for the job for which the second discharge port is set, the discharge port information is changed to the first discharge port and the presence of a change is informed (S319). In this manner there can be utilized a discharge path without abnormality, without a cumbersome operation of changing the discharge path for the print of the printer, the FAX print or the copy each time, whereby the throughput of the apparatus can be improved.

Then the sensor 308 is used for discriminating whether an abnormality such as paper jamming is present in the third discharge port 24 (S315, S316). This process is same also in case the second discharge port 23 is not designated or in case the second discharge port 23 is not abnormal. In case the third discharge port 24 has an abnormality such as paper jamming, the discharge to the second discharge port 23 also becomes abnormal since the second discharge port 23 constitutes the conveying path to the third discharge port 24. Thus the job for which the third discharge port 24 is designated cannot use the second discharge port, so that, if the discharge to the first discharge port is possible, the discharge port information is changed to the first discharge port and the presence of a change is informed (S320). In this manner there can be utilized a discharge path without abnormality, without a cumbersome operation of changing the discharge path for the print of the printer, the FAX print or the copy each time, whereby the throughput of the apparatus can be improved.

In case the third discharge port 24 is not in an abnormal state, there is discriminated whether an abnormality such as paper jamming is present in the finisher 27 (S317). In case of an abnormality in the finisher 27, for the job for which the third discharge port 24 is set, the setting is changed to the available first discharge port 22 or second discharge port 23 and such change is informed (S321), whereupon the present task is terminated.

In the foregoing, the paper jamming is assumed to be an abnormality in the discharge port, but there may also be detected other phenomena such as a failure in the finisher or absence of staple in the stapler as the abnormality. Also the aforementioned control is assumed to be executed by the MPU 201, but such example is not restrictive and a similar control can be executed by the CPU 101 or by the printer driver of the PC terminal on the LAN. Also the information indicating the presence of a change in the discharge port information, set in the aforementioned control, is utilized in the single-side paper task explained in the foregoing.

In the foregoing, the rollers other than those 403, 404 are assumed to be driven by independent stepping motors or DC motors, but such other rollers may also be driven, like the rollers 403 and 404, by the motor 208, utilizing a speed varying mechanism and a clutch as in the driving mechanism 206.

Inversely, it is also possible to drive the rollers 403, 404 with the independent motors. In such case, clutches or the like are provided between the motors and the rollers 403, 404 to release the same from the driving force thereby enabling free rotation of the rollers 403, 404 at the sheet deceleration as in the aforementioned step S304 or at the sheet pushing operation by the rollers 417 of the dual-side unit.

Figure 23:
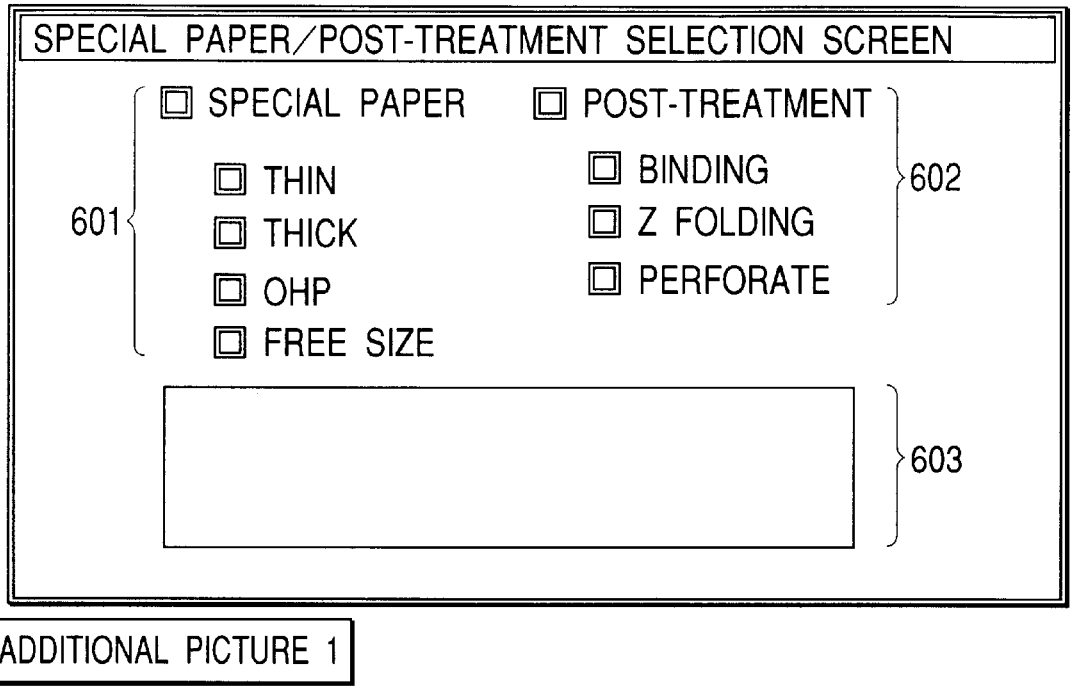
FIGS. 23, 24 and 25 are views showing an example of the user interface for designating post-treatment and special paper by an operation panel 112 shown in FIG. 2.
Figure 24:
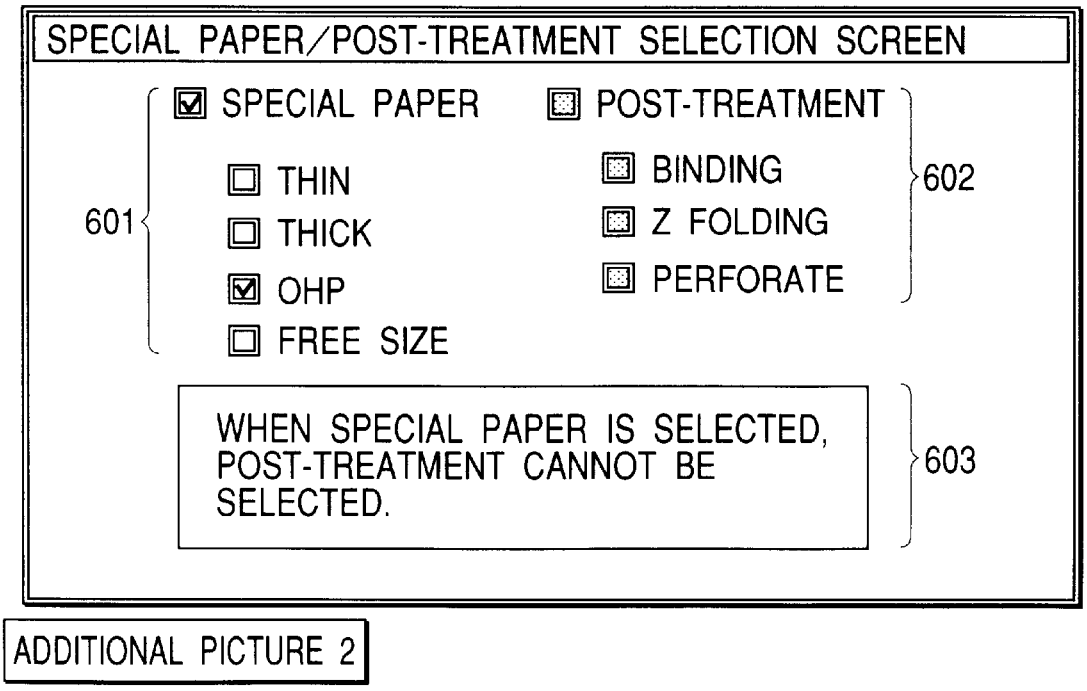
Figure 25:
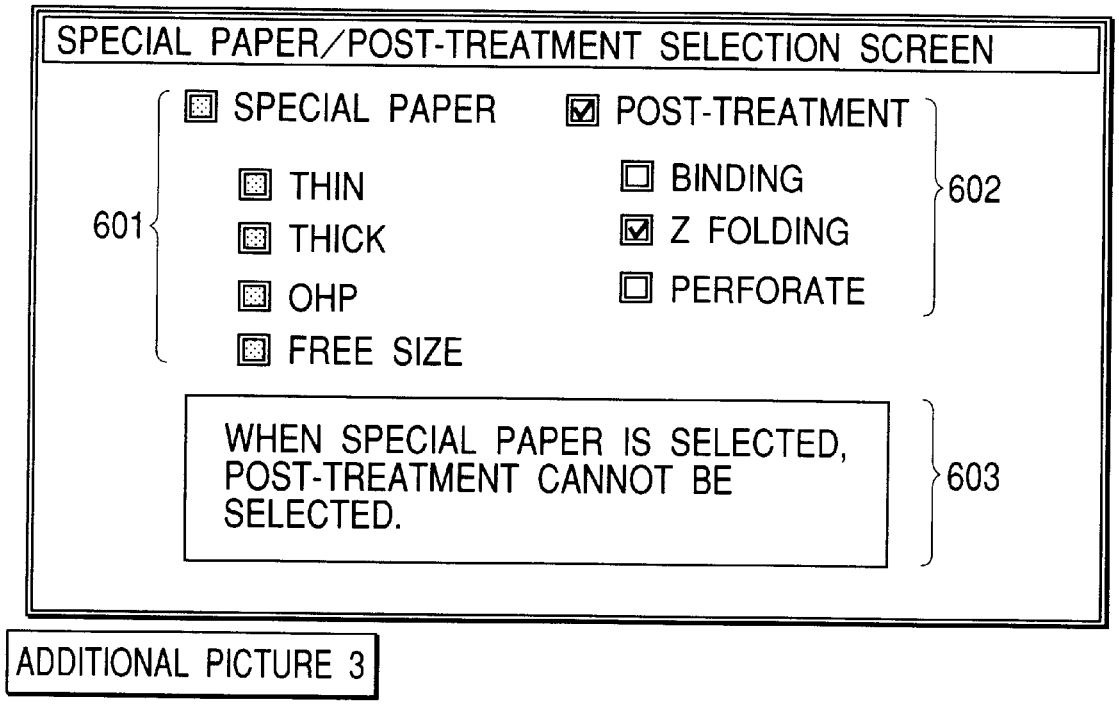

FIGS. 23 to 25 show an example of the user interface for designating special paper or a post-treatment such as book binding or folding (special paper selecting control corresponds to the aforementioned process in FIG. 9). The process shown in FIGS. 23 to 25 may be constructed as a program for the CPU 101 and stored in the ROM 110.

As explained in the foregoing, the special paper is discharged to the first discharge path 22, while the third discharge path 24 is selected in case a function of the finisher 27 is selected. Therefore the special paper and the post-treatment setting are not compatible.

FIGS. 23 to 25 show an image (or screen) on the operation panel 112 for selecting the special paper and the mode of post-treatment, and such interface allows the user to set the special paper and the post-processing within a same image. In this image, there are provided buttons 601 for selecting the mode of special paper, those 602 for selecting the mode of post-processing, and an echo area 603 for displaying an error (or alarm) message. The user can execute setting of the special paper and that of the post treatment by operating the aforementioned buttons 601, 602 by an unrepresented pointing device (mouse or the like) or by a touch panel provided on the display of the operation panel 112.

The present user interface executes control in such a manner that the designation of special paper and the designation of post-processing can be selected only in exclusive manner.

More specifically, in case the user sets the OHP sheet as the special paper as shown in FIG. 24, the CPU 101 has to execute the discharge by the first discharge Path 22, so that the image is so controlled as to disable the setting on the finisher 27. More specifically, after a button 601 for selecting a mode of special paper is selected as shown in FIG. 24, the buttons 602 for selecting the modes of post-processing are displayed with a lowered display luminance (or a lowered density) to indicate that the selection is disabled (also input on the buttons 602 being disregarded). Also the echo area 603 is used to display an alarm message "Post-processing cannot be selected when special paper is selected".

Also in case the user sets the Z-folding as the post-treatment by the finisher 27 as shown in FIG. 25, the CPU 101 has to execute the discharge by the third discharge path 24, so that the image is so controlled as to disable the setting on the special paper. More specifically, after a button 602 for selecting a mode of post-processing is selected as shown in FIG. 25, the buttons 601 for selecting the modes of special paper are displayed with a lowered display luminance (or a lowered density) to indicate that the selection is disabled (also input on the buttons 601 being disregarded). Also the echo area 603 is used to display an alarm message "Special paper cannot be selected when post-processing is selected".

In the foregoing description, the images (or screens) shown in FIGS. 23 to 25 are assumed to be displayed on the operation panel 112, but a similar control can also be achieved by a driver software of the client PC on the LAN. Such driver software contains in advance the processes shown in FIGS. 23 to 25 and may be stored in a hard disk shown in FIG. 5 28. Such driver software enables the user of PC to execute such control as to select the designation of special paper and the designation of post-processing only in exclusive manner, without going to the location of the apparatus, thus providing an advantage for the PC user. Also in the foregoing description, the image is so constructed as to execute the selections of special paper and post-processing within a same image, but there is only required such control that the settings of special paper and post-processing are not compatible in the setting image and it is not necessary to execute the setting of special paper and that of post-processing within a same image as shown in FIGS. 23 to 25.

Figure 26:
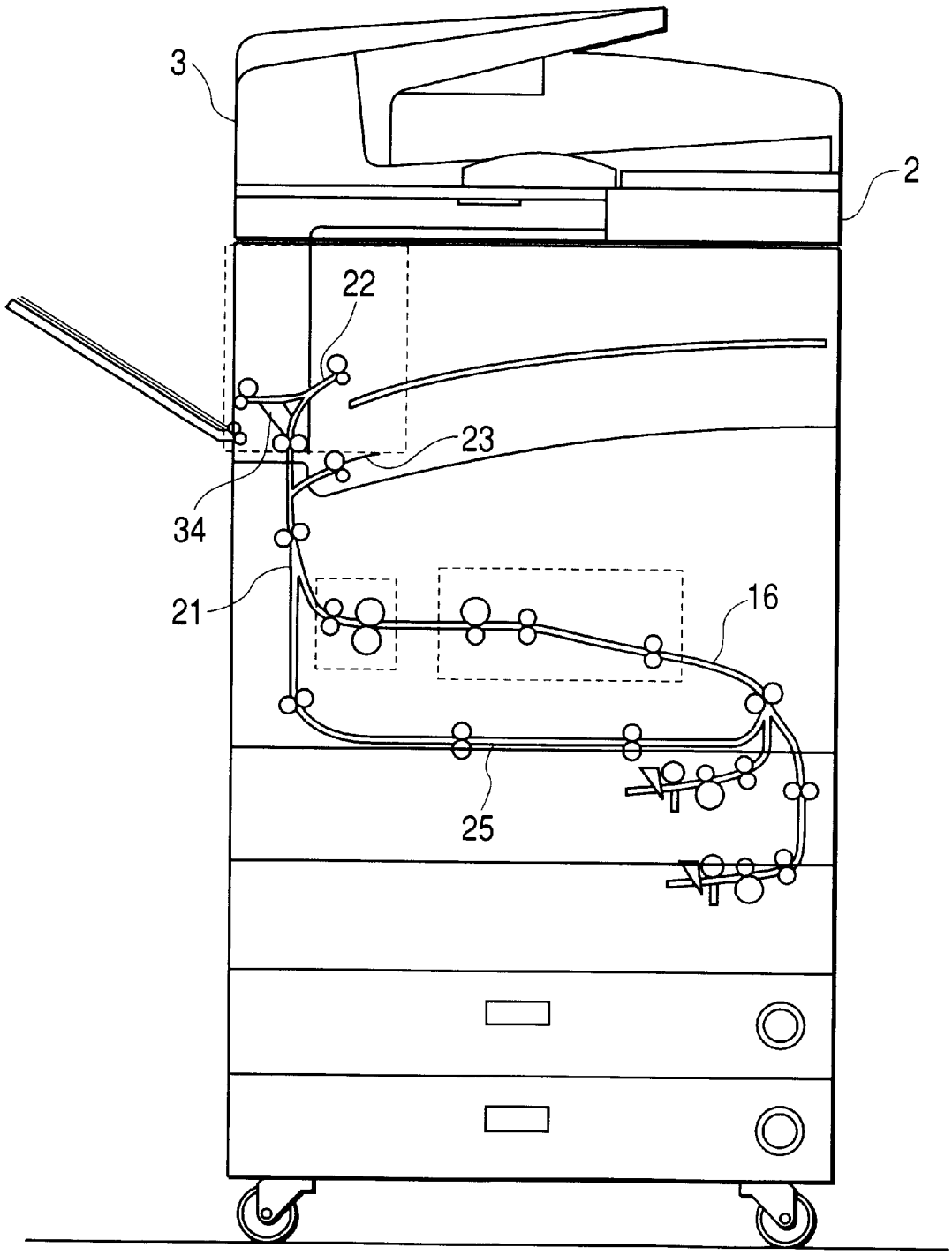
FIG. 26 is a cross-sectional view of an image forming apparatus employed as another embodiment of the present invention.

FIG. 26 shows another embodiment of the present invention, wherein the lower discharge path has a larger curvature (stronger curve) while the upper discharge path has a smaller curvature (milder curve). Such configuration also limits the height of the apparatus and improves the convenience of use thereof (original handing on the original table 2 and operability of the operation unit) as in the embodiment shown in FIG. 1. In such case, it will be obvious that, in case of special paper setting, the upper discharge path 22 with smaller curvature is used as the first discharge path 22 shown in FIG. 1 and the lower discharge path 23 is used as the second discharge path 23 shown in FIG. 1.

Figure 27:
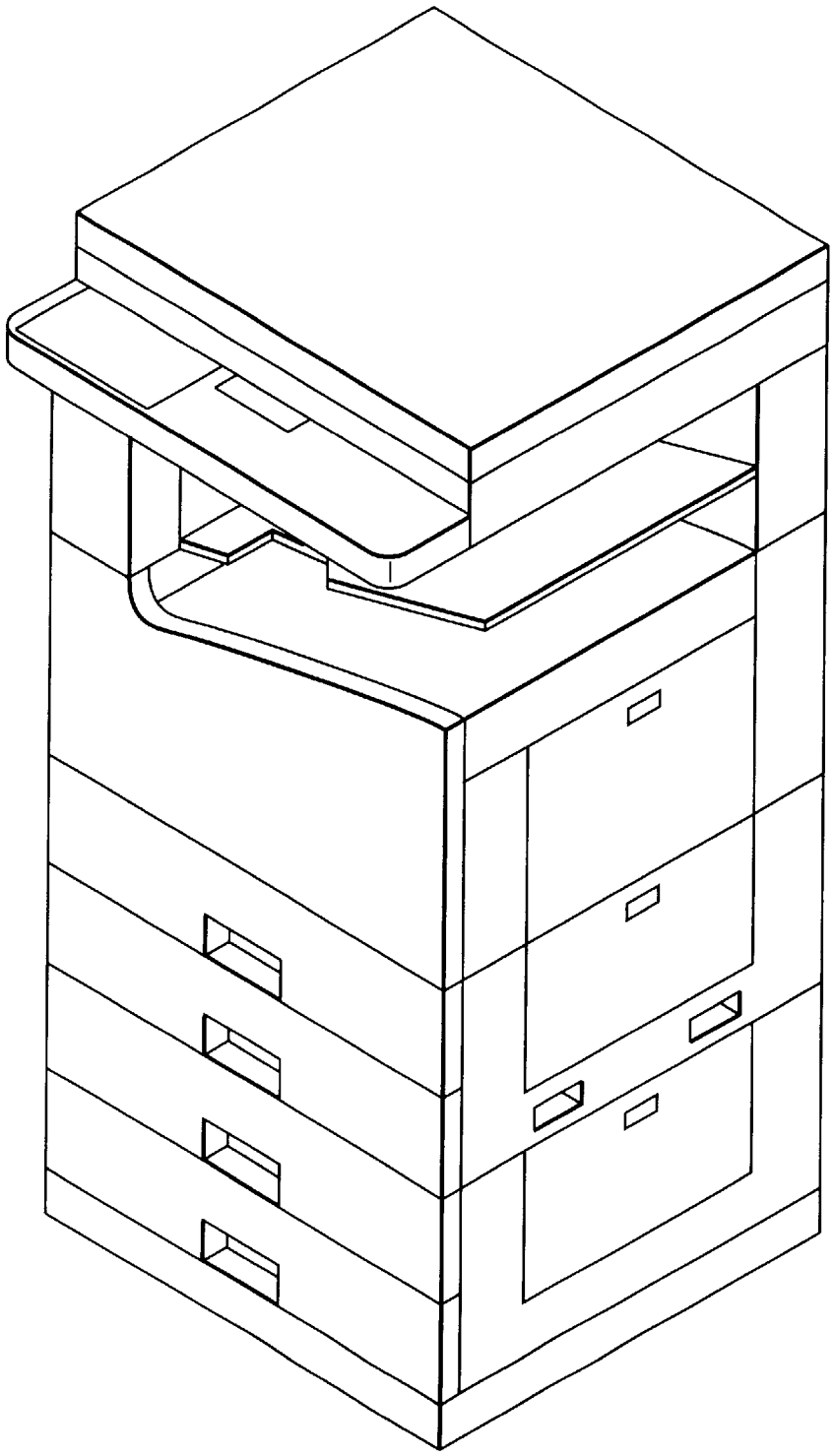
FIG. 27 is a perspective view of the image forming apparatus shown in FIG. 26.

FIG. 27 is a perspective view of the image forming apparatus of the another embodiment shown in FIG. 26.

In the foregoing, there has been explained a case of forming two discharge ports in the body, but the configuration of the present invention becomes more effective in limiting the height of the apparatus in case three or more discharge ports are provided.

Figure 28:
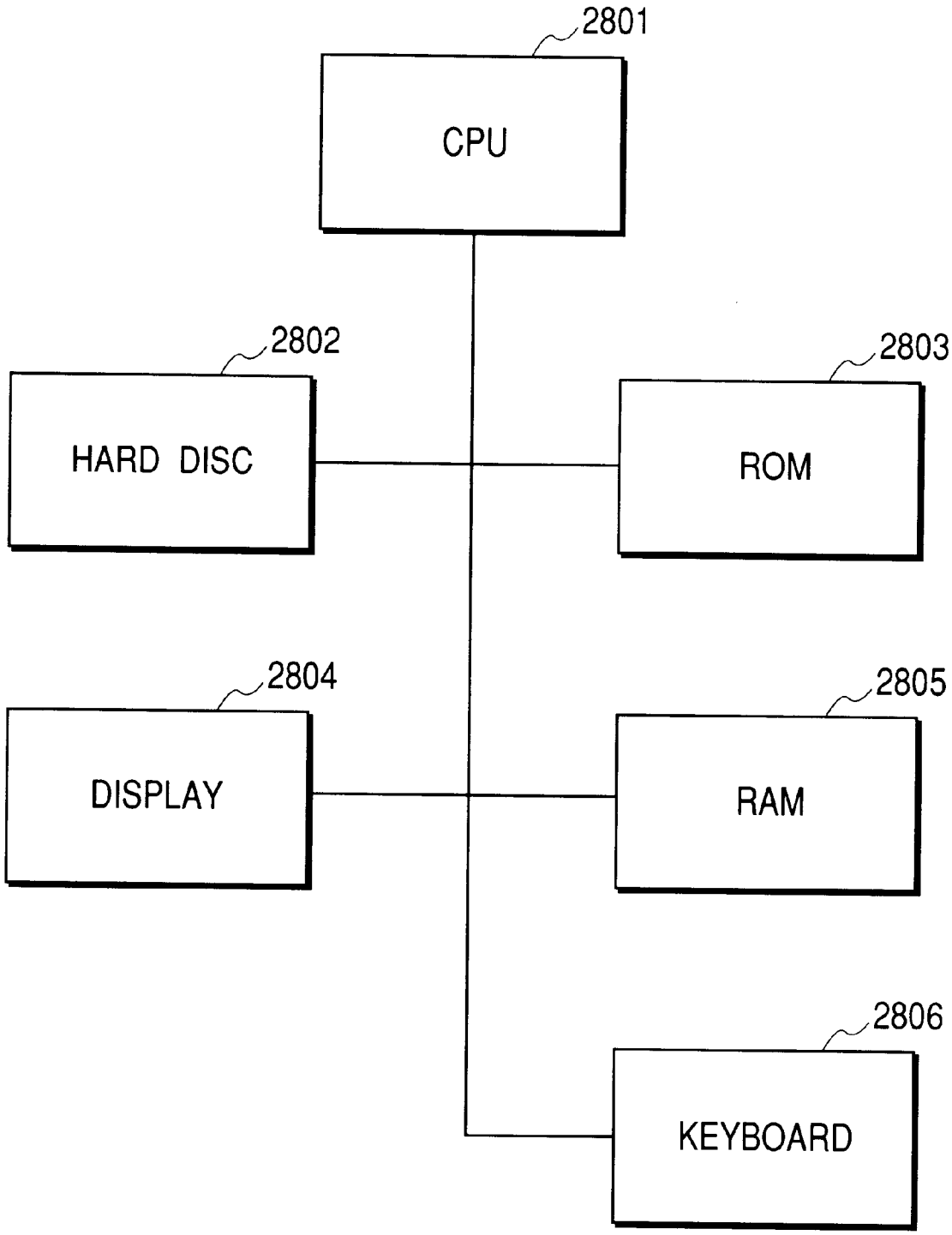
FIG. 28 is a view showing the configuration of a PC connected to a LAN interface 102.

FIG. 28 shows the configuration of a PC connected to the LAN interface unit 102, wherein provided are a CPU 2801 for controlling the entire PC, a hard disk 2802 storing programs, including a driver software for remote control of the image forming apparatus in the control as shown in FIGS. 23 to 25, a ROM 2803 storing programs to be executed by the CPU 2801, a display 2804 for displaying images as shown in FIGS. 23 to 25, a RAM 2805 to be used as a work area in the program execution, and an operation unit 2806 including a mouse, a keyboard, etc. With the driver software as shown in FIGS. 23 to 25, there are executed selection of discharge paths, setting of special paper and post-processing.

The aforementioned embodiments provide following excellent effects in the control of the sheet conveying speed.

At first, a configuration of conveying sheet, in the conveying paths before and after the latent image forming drum (image forming means) 18, at a higher conveying speed than the conveying speed (140 mm/sec) in the vicinity of the latent image forming drum 18 provides an excellent effect of reducing the staying time of the sheet in the apparatus, thereby significantly improving the throughput of the image forming process.

In particular, the sheet conveying from the sheet cassettes to the latent image forming drum 18 can be made faster by a configuration of conveying the sheet from the sheet cassettes 11 to 13 by the rollers 402 at a speed of 210 mm/sec faster than the sheet conveying speed of 140 mm/sec in the vicinity of the latent image forming drum 18, then accelerating the sheet to 280 mm/sec by the rollers 403, 404 and decelerating the sheet by the rollers 405 immediately in front of the latent image forming drum 18 to the sheet conveying speed (140 mm/sec) in the vicinity of the latent image forming drum 18.

Also the sheet conveying in the conveying path after the latent image forming drum (image forming means) 18 can be made faster by a configuration of accelerating the sheet to 350 mm/sec at maximum for the sheet discharge, after passing the latent image forming drum 18, thermal fixation roller 20 and rollers 409.

Also in case of dual-side recording, the sheet conveying in the conveying path after the latent image forming drum (image forming means) 18 can be made faster by accelerating the sheet to 350 mm/sec at maximum for re-feeding in the dual-side unit.

Also, at the sheet discharge, the sheet is discharged from the discharge path by accelerating to 350 mm/sec only in the absence of the succeeding sheet but such acceleration is not executed in the presence of the succeeding sheet, so that there can be achieved high-speed and appropriate discharge control satisfying both the high-speed sheet conveying and the sheet alignment on the discharge tray.

Furthermore, in transferring the sheet from the rollers 417 of the dual-side unit to the rollers 403, 404 and decelerating the sheet by the rollers 405, the rollers 403, 404 are released from the driving power of the driving mechanism 206 whereby appropriate sheet re-feeding can be achieved without generating a loop even in a long sheet which may simultaneously engage with the rollers 417, 405, thus without causing jamming, deformation or breakage of the sheet or deterioration of the recorded image quality and also without deficiency in the conveying power.

Also the aforementioned embodiments provide following excellent effects in the arrangement of the discharge paths.

At first, in the in-body sheet discharge configuration as in the foregoing embodiments, it is difficult to reduce the curvature of the conveying path in the second and third discharge paths because of the limitation in the height of the apparatus. Consequently, the first discharge path 22 is given a smaller curvature to enable discharge of special paper while other discharge paths are given a larger curvature. In this manner there is obtained an excellent effect of meeting the requirement for the height of the apparatus and also passing special paper without damaging.

Also, in the in-body sheet discharge configuration as in the foregoing embodiments, it is difficult to provide a high performance finisher in the upper second and third discharge paths, executing such in-body discharge, because of the limitation in space. Therefore, by positioning a discharge port capable of connecting a high performance finisher on a lateral face of the image forming apparatus, there can be obtained an excellent effect of meeting the requirement in the height of the apparatus.

Furthermore, by effectively providing plural discharge paths in the image forming apparatus, there can be obtained an excellent effect that the units for realizing the aforementioned various functions can be incorporated, utilizing such plural discharge paths, in the limited space of the casing. Furthermore, in case of forming the dual-side path for re-feeding below the process unit, there can be obtained an excellent effect of meeting the stricter requirement in the height of the apparatus. Also in case of constructing a composite apparatus as explained in the present invention by attaching a scanner, an operation unit or a discharge unit in the upper part of an existing printer, there can be obtained an excellent effect that the apparatus can be very easily constructed, for example in the configuration of the first embodiment, by employing the discharge path of the existing printer and merely attaching the second discharge path.

Also the aforementioned embodiments provide the following excellent effects in the control for selecting the discharge paths.

At first, since there are set default conditions for controlling the discharge paths, namely specified conditions for selecting one of the plural discharge paths 22 to 24 for discharge, such as conditions for selecting a specified discharge path according to whether the image input means employed for the input of the image to be recorded is 5 the FAX interface unit 103, the LAN interface unit 102 or the printer interface unit 104 or according to the print job or the client in case of an image input from an external PC terminal, there can be obtained an excellent effect that the apparatus discharges the print of printer mode/FAX mode/copy mode in classified manner so that the user can easily take out the desired print. Also a configuration of selecting a specified one of the plural discharge paths according to the function state of the apparatus such as designation of specified post-processing, designation of special paper or an error state, regardless of the default conditions for controlling the discharge paths, provides an excellent effect that the plural discharge paths can be appropriately selected and that the plural discharge paths can be automatically selected without requiring any cumbersome selecting operation. Furthermore, there can be obtained an excellent effect that the discharge path for special paper or that for finisher can also be used for the classified discharge for the prints of printer mode/FAX mode/ copy mode, whereby the apparatus can be made compact.

In particular, the configuration of selecting a specified on of the discharge paths according to the designation of special paper or post-processing, regardless of the default conditions for controlling the discharge paths, is very effective in the configuration utilizing in-body sheet discharge and also utilizing an external large-sized finisher as in the foregoing embodiments.

For example, in the in-body sheet discharge configuration as in the foregoing embodiments, it is difficult to provide a high performance finisher in the upper first and second discharge paths 22, 23, executing such in-body discharge, because of the limitation in space. Therefore, the discharge to the third discharge path 24 is necessary in case of designation of a specified post-processing to be executed in the external finisher 27 which is not limited in space in the upper or lower part thereof. In such configuration, therefore, by automatically selecting the third discharge path 24 regardless of the default conditions for controlling the discharge paths in case of designation of a specified post-processing to be executed by the external finisher 27, there can be obtained an excellent effect of automatically and appropriately selecting the plural discharge paths without requiring any cumbersome selecting operation.

Also in the discharge path configuration utilizing different discharge paths for the designation of post-processing and that of special paper as in the foregoing embodiments shown in FIGS. 23 to 25, a configuration of prohibiting either of the designation of the post-processing and the designation of the special paper in case the other is designated by the user provides an excellent effect of preventing erroneous function of the apparatus by a useless designating operation and allowing the user to recognize the function of the apparatus and the method of use thereof while the apparatus in actual use.

Also a configuration of positioning the first discharge path between the reading means and the recording means, also positioning the third discharge path so as to execute discharge to the exterior, which is not limited in upper or lower space, of the image forming apparatus, and rendering the third discharge path connectable to the post-processing apparatus thereby dispensing with such post-processing apparatus, there can be obtained an excellent effect that the installation area can be made very small and that there can be mounted even a high performance post-processing apparatus.

Also, since the first discharge path has such a curvature capable of discharging special paper, there can be obtained an excellent effect that any paper can be passed therein in a standard configuration without the post-processing apparatus.

Also, since the first discharge path has such a curvature capable of discharging special paper and smaller than the curvature of the second discharge path, there can be obtained an excellent effect that any paper can be passed therein in a standard configuration without the post-treatment apparatus and that the height of the apparatus can be limited even in the presence of the second discharge path.

As will be apparent from the foregoing description, by effectively providing plural discharge paths in the image forming apparatus, there can be obtained an excellent effect that the units for realizing the aforementioned various functions can be incorporated, utilizing such plural discharge paths, in the limited space of the casing.

Also in an image forming apparatus provided with plural discharge paths and adapted, after image formation by image forming means of a predetermined system, to discharge an image bearing sheet from any of such discharge paths to the exterior of the apparatus, a control method for the image forming apparatus and a control program for the image forming apparatus, there is adopted such control as to set one of the plural discharge paths for each of the print of printer mode/FAX mode/copy mode and to select specified one of the plural discharge paths for discharge, regardless of the aforementioned setting, according to the function state of the apparatus (selection of special paper, selection of post-processing function or abnormality in the discharge path), so that there can be obtained an excellent effect of appropriately setting the selection of the plural discharge paths of the image forming apparatus and automatically and appropriately selecting the plural discharge paths according to other conditions such as designation of a specified post-processing, designation of special paper or error generation, without requiring a cumbersome selecting operation. Also there can be obtained an excellent effect that the discharge path for special paper or that for finisher can also be used for the classified discharge for the prints of printer mode/FAX mode/ copy mode, whereby the apparatus can be made compact. Also there can be obtained an excellent effect of improving the operability of the original on the original table or of the operation unit. Also in the designation of the post-processing and the designation of the special paper which can only be utilized in exclusive manner because of the configuration of the apparatus, there can be obtained an excellent effect of preventing erroneous function of the apparatus by a useless designating operation and allowing the user to recognize the function of the apparatus and the method of use thereof while the apparatus in actual use.

Also such control may be incorporated in a software to be used in a PC for controlling the present apparatus, and such control provides an excellent effect of enabling the user of PC to select the designation of special paper and the designation of post-processing only in exclusive manner, without going to the location of the apparatus, thus providing an advantage for the PC user.

Also a configuration of positioning the first discharge path between the reading means and the recording means, also positioning the third discharge path so as to execute discharge to the exterior, which is not limited in upper or lower space, of the image forming apparatus, and rendering the third discharge path connectable to the post-processing apparatus thereby dispensing with such post-processing apparatus, there can be obtained an excellent effect that the installation area can be made very small and that there can be mounted even a high performance post-treatment apparatus.

Also, since the first discharge path has such a curvature capable of discharging special paper, there can be obtained an excellent effect that any paper can be passed therein in a standard configuration without the post-processing apparatus.

Also, since the first discharge path has such a curvature capable of discharging special paper and smaller than the curvature of the second discharge path, there can be obtained an excellent effect that any paper can be passed therein in a standard configuration without the post-processing apparatus and that the height of the apparatus can be limited 5 even in the presence of the second discharge path.

It is to be understood that the phraseology or terminology herein is for the purpose of description and not of limitation.

While the invention has been described with reference to the embodiments disclosed herein, it is not confined to the details set forth and this application is intended to cover such modification or changes as many come within the purpose of the improvements or the scope of the following claims.

What is claimed is:

1. An image forming apparatus comprising:

first reception means for receiving print data from an external terminal;

second reception means for receiving read image data;

discrimination means for discriminating whether the reception is made either from said first reception means or said second reception means;

recording means for recording an image on a recording medium based on the received data;

first discharge means and second discharge means for discharging the recording medium recorded by said recording means;

discharge setting means for setting whether to discharge the recording medium to said first discharge means or to said second discharge means respectively corresponding to said first reception means and said second reception means;

selection means for selecting either said first discharge means or said second discharge means; and special paper setting means for setting special paper as the type of the recording medium to be recorded by said recording means, wherein said selection means selects said first discharge means regardless of the setting by said discharge setting means in case the special paper is set by said special paper setting means, wherein said first discharge means is positioned between a reading means and said recording means, and said second discharge means is so positioned as to be connectable to a post-treatment apparatus and to execute a discharge to an exterior of said image forming apparatus.

2. An image forming apparatus according to claim 1, further comprising third reception means for receiving print data from a public line, wherein said discrimination means discriminates whether the reception is made either from said first reception means or said second reception means or said third reception means, and third discharge means for discharging the recording medium recorded by said recording means, wherein said discharge setting means sets the discharge of the recording medium to any of said first discharge means, said second discharge means and said third discharge means respectively corresponding to said first reception means, said second reception means and said third reception means, and said selection means selects any of said first discharge means, said second discharge means or said third discharge means.

3. An image forming apparatus according to claim 2, wherein said first discharge means and said third discharge means are positioned between said reading means and said recording means, and said second discharge means is so positioned as to be connectable to a post-treatment apparatus and to execute discharge to the exterior of said image forming apparatus.

4. An image forming apparatus according to claim 1, wherein said first discharge means has a curvature capable of discharging the special paper.

5. An image forming apparatus according to claim 1, wherein said first discharge means has a curvature capable of discharging the special paper and smaller than the curvature of said third discharge means.

6. An image forming apparatus comprising:

first reception means for receiving print data from an external terminal;

second reception means for receiving read image data;

discrimination means for discriminating whether the reception is made either from said first reception means or said second reception means;

recording means for recording an image on a recording medium based on the received data;

first discharge means and second discharge means for discharging the recording medium recorded by said recording means;

discharge setting means for setting whether to discharge the recording medium to said first discharge means or to said second discharge means respectively corresponding to said first reception means and said second reception means;

selection means for selecting either said first discharge means or said second discharge means;

post-treatment setting means for setting post-treatment after recording by said recording means; and post-treatment means for executing said post-treatment and connected to the second discharge means, wherein said selection means selects the second discharge means regardless of the setting by said discharge setting means in case the post-treatment is set by said post-treatment setting means, wherein said first discharge means is positioned between reading means and said recording means, and said second discharge means is so positioned as to be connectable to a post-treatment apparatus and to execute a discharge to an exterior of said image forming apparatus.

7. An image forming apparatus according to claim 6, further comprising third reception means for receiving print data from a public line, wherein said discrimination means discriminates whether the reception is made either from said first reception means or said second reception means or said third reception means, and third discharge means for discharging the recording medium recorded by said recording means, wherein said discharge setting means sets the discharge of the recording medium to any of said first discharge means, said second discharge means and said third discharge means respectively corresponding to said first reception means, said second reception means and said third reception means, and said selection means selects any of said first discharge means, said second discharge means or said third discharge means.

8. An image forming apparatus according to claim 7, wherein said first discharge means and said third discharge means are positioned between said reading means and said recording means, and said second discharge means is so positioned as to be connectable to a post-treatment apparatus and to execute discharge to the exterior of said image forming apparatus.

9. An image forming apparatus according to claim 8, wherein said first discharge means has a curvature capable of discharging special paper and smaller than the curvature of said third discharge means.

10. An image forming apparatus according to claim 6, wherein said first discharge means has a curvature capable of discharging special paper.

11. An image forming apparatus comprising:

first reception means for receiving print data from an external terminal;

second reception means for receiving read image data;

discrimination means for discriminating whether the reception is made either from said first reception means or said second reception means;

recording means for recording an image on a recording medium based on the received data;

first discharge means and second discharge means for discharging the recording medium recorded by said recording means;

discharge setting means for setting whether to discharge the recording medium to said first discharge means or to said second discharge means respectively corresponding to said first reception means and said second reception means;

selection means for selecting either said first discharge means or said second discharge means; and first detection means and second detection means for respectively detecting whether said first discharge means and said second discharge means are abnormal, wherein said selection means selects said first discharge means regardless of the setting by said discharge setting means in case said second detection means detects an abnormality in said second discharge means and the discharge to said first discharge means is possible, wherein said first discharge means is positioned between reading means and said recording means, said second discharge means is so positioned as to be connectable to a post-treatment apparatus and to execute a discharge to an exterior of said image forming apparatus, and said first discharge means is positioned at an upstream side of said second discharge means.

12. An image forming apparatus according to claim 11, further comprising third reception means for receiving print data from a public line, wherein said discrimination means discriminates whether the reception is made either from said first reception means or said second reception means or said third reception means, and third discharge means for discharging the recording medium recorded by said recording means, wherein said discharge setting means sets the discharge of the recording medium to any of said first discharge means, said second discharge means and said third discharge means respectively corresponding to said first reception means, said second reception means and said third reception means, and said selection means selects any of said first discharge means, said second discharge means or said third discharge means.

13. An image forming apparatus according to claim 12, further comprising third detection means for detecting whether said third discharge means is abnormal, wherein said selection means selects said first discharge means regardless of the setting by said discharge setting means in case said third detection means detects an abnormality in said third discharge means and the discharge to said first discharge means is possible.

14. An image forming apparatus according to claim 12, wherein said first discharge means and said third discharge means are positioned between said reading means and said recording means said second discharge means is so positioned as to be connectable to a post-treatment apparatus and to execute discharge to the exterior of said image forming apparatus, and said first discharge means is positioned at the upstream side of said second and third discharge means.

15. An image forming apparatus according to claim 14, wherein said first discharge means has a curvature capable of discharging special paper and smaller than the curvature of said third discharge means.

16. An image forming apparatus according to claim 11, wherein said first discharge means has a curvature capable of discharging special paper.

17. An image forming apparatus comprising:

first reception means for receiving print data from an external terminal;

second reception means for receiving read image data;

discrimination means for discriminating whether the reception is made either from said first reception means or said second reception means;

recording means for recording an image on a recording medium based on the received data;

first discharge means and second discharge means for discharging the recording medium recorded by said recording means;

discharge setting means for setting whether to discharge the recording medium to said first discharge means or to said second discharge means respectively corresponding to said first reception means and said second reception means;

selection means for selecting either said first discharge means or said second discharge means;

special paper setting means for setting special paper as the type of the recording medium to be recorded by said recording means;

post-treatment setting means for setting post-treatment after recording by said recording means; and post-treatment means for executing said post-treatment and connected to said second discharge means, wherein said selection means selects said first discharge means regardless of the setting by said discharge setting means in case the special paper is set by said special paper setting means, and said selection means selects the second discharge means regardless of the setting by said discharge setting means in case the post-treatment is set by said post-treatment setting means.

18. An image forming apparatus according to claim 17, further comprising first detection means and second detection means for respectively detecting whether said first discharge means and said second discharge means are abnormal, wherein said selection means selects said first discharge means regardless of the setting by said discharge setting means in case said second detection means detects an abnormality in said second discharge means and the discharge to said first discharge means is possible.

19. An image forming apparatus according to claim 17, further comprising third reception means for receiving print data from a public line, wherein said discrimination means discriminates whether the reception is made either from said first reception means or said second reception means or said third reception means, and third discharge means for discharging the recording medium recorded by said recording means, wherein said discharge setting means sets the discharge of the recording medium to any of said first discharge means, said second discharge means and said third discharge means respectively corresponding to said first reception means, said second reception means and said third reception means, and said selection means selects any of said first discharge means, said second discharge means or said third discharge means.

20. An image forming apparatus according to claim 19, further comprising third detection means for detecting whether said third discharge means is abnormal, wherein said selection means selects said first discharge means regardless of the setting by said discharge setting means in case said third detection means detects an abnormality in said third discharge means and the discharge to said first discharge means is possible.

21. An image forming apparatus according to claim 19, wherein said first discharge means and said third discharge means are positioned between a reading means and said recording means, and said second discharge means is so positioned as to connectable to a post-treatment apparatus and to execute discharge to the exterior of said image forming apparatus.

22. An image forming apparatus according to claim 21, wherein said first discharge means has a curvature capable of discharging special paper and smaller than the curvature of said third discharge means.

23. An image forming apparatus according to claim 17, wherein said first discharge means is positioned between a reading means and said recording means, and said second discharge means is so positioned as to be connectable to a post-treatment apparatus and to execute discharge to the exterior of said image forming apparatus.

24. An image forming apparatus according to claim 23, wherein said first discharge means has a curvature capable of discharging special paper.

25. An image forming apparatus provided with first reception means for receiving print data from an external terminal, reading means for reading an image and outputting read print data, and recording means for recording an image on a recording medium based on the received or read data, the apparatus comprising:

discrimination means for discriminating whether the reception is made either from said first reception means or said reading means;

first discharge means and second discharge means for discharging the recording medium recorded by the recording means;

sheet discharge setting means for setting whether to discharge the recording medium to said first discharge means or to said second discharge means respectively corresponding to said first reception means and said reading means, wherein said first discharge means is positioned between said reading means and said recording means, and said second discharge means is connectable to a post-treatment apparatus and is so positioned as to discharge the recording medium to the exterior of said image forming apparatus;

selection means for selecting said first discharge means or said second discharge means;

special paper setting means for setting special paper as the type of the recording medium;

post-treatment setting means for setting post-treatment after recording by said recording means; and post-treatment means for executing said post-treatment, wherein said special paper setting means and said post-treatment setting means are exclusively selected.

26. An image forming apparatus according to claim 25, wherein said first discharge means has a curvature capable of discharging the special paper.

27. A control program for controlling, from a remote external information processing terminal, an image forming apparatus provided with first reception means for receiving print data from an external terminal, reading means for reading an image and outputting read print data, and recording means for recording an image on a recording medium based on the received or read data, the apparatus further including discrimination means for discriminating whether the reception is made either from said first reception means or said reading means, first discharge means and second discharge means for discharging the recording medium recorded by said recording means, sheet discharge setting means for setting whether to discharge the recording medium to said first discharge means or to said second discharge means respectively corresponding to said first reception means and said reading means, wherein said first discharge means is positioned between said reading means and said recording means, and said second discharge means is connectable to a post-treatment apparatus and is so positioned as to discharge the recording medium to the exterior of said image forming apparatus, and selection means for selecting said first discharge means or said second discharge means, said program comprising:

a special paper setting step of setting special paper as the type of the recording medium; and a post-treatment setting step of setting post-treatment after recording by said recording means, wherein said special paper setting step and said post-treatment setting step are exclusively selected.

28. A method for controlling an image forming apparatus, including steps of:

providing first reception means for receiving print data from an external terminal;

providing second reception means for receiving read image data;

providing discrimination means for discriminating whether the reception is made either from said first reception means or said second reception means;

providing recording means for recording an image on a recording medium based on the received data;

providing first discharge means and second discharge means for discharging the recording medium recorded by said recording means;

providing discharge setting means for setting whether to discharge the recording medium to said first discharge means or to said second discharge means respectively corresponding to said first reception means and said second reception means;

providing selection means for selecting either said first discharge means or said second discharge means;

providing special paper setting means for setting special paper as the type of the recording medium to be recorded by said recording means; and selecting said first discharge means by said selection means regardless of the setting by said discharge setting means in case the special sheet is set by said special paper setting means, wherein said first discharge means is positioned between reading means and said recording means, and said second discharge means is so positioned as to be connectable to a post-treatment apparatus and to execute a discharge to an exterior of said image forming apparatus.

29. A method for controlling an image forming apparatus according to claim 28, further including steps of:

providing third reception means for receiving print data from a public line, wherein said discrimination means discriminates whether the reception is made either from said first reception means or said second reception means or said third reception means, providing third discharge means for discharging the recording medium recorded by said recording means, setting, by said discharge setting means, the discharge of the recording medium to any of said first discharge means, said second discharge means and said third discharge means respectively corresponding to said first reception means, said second reception means and said third reception means, and selecting, by said selection means, any of said first discharge means, said second discharge means or said third discharge means.

30. A method for controlling an image forming apparatus according to claim 29, wherein said first discharge means and said third discharge means are positioned between said reading means and said recording means, and said second discharge means is so positioned as to be connectable to a post-treatment apparatus and to execute discharge to the exterior of said image forming apparatus.

31. A method for controlling an image forming apparatus according to claim 28, wherein said first discharge means has a curvature capable of discharging the special paper.

32. A method for controlling an image forming apparatus according to claim 28, wherein said first discharge means has a curvature capable of discharging the special paper and smaller than the curvature of said third discharge means.

33. A method for controlling an image forming apparatus, including steps of:

providing first reception means for receiving print data from an external terminal;

providing second reception means for receiving read image data;

providing discrimination means for discriminating whether the reception is made either from said first reception means or said second reception means;

providing recording means for recording an image on a recording medium based on the received data;

providing first discharge means and second discharge means for discharging the recording medium recorded by said recording means;

providing discharge setting means for setting whether to discharge the recording medium to said first discharge means or to said second discharge means respectively corresponding to said first reception means and said second reception means;

providing selection means for selecting either said first discharge means or said second discharge means;

providing post-treatment setting means for setting a post-treatment after recording by said recording means;

providing post-treatment means for executing said post-treatment and connected to the second discharge means, and selecting, by said selection means, the second discharge means regardless of the setting by said discharge setting means in case the post-treatment is set by said post-treatment setting means, wherein said first discharge means is positioned between reading means and said recording means, and said second discharge means is so positioned as to be connectable to a post-treatment apparatus and to execute a discharge to an exterior of said image forming apparatus.

34. A method for controlling an image forming apparatus according to claim 33, further including steps of:

providing third reception means for receiving print data from a public line, wherein said discrimination means discriminates whether the reception is made either from said first reception means or said second reception means or said third reception means, third discharge means for discharging the recording medium recorded by said recording means, setting, by said discharge setting means, the discharge of the recording medium to any of said first discharge means, said second discharge means and said third discharge means respectively corresponding to said first reception means, said second reception means and said third reception means, and selecting, by said selection means, any of said first discharge means, said second discharge means or said third discharge means.

35. A method for controlling an image forming apparatus according to claim 34, wherein said first discharge means and said third discharge means are positioned between said reading means and said recording means, and said second discharge means is so positioned as to be connectable to a post-treatment apparatus and to execute discharge to the exterior of said image forming apparatus.

36. A method for controlling an image forming apparatus according to claim 35, wherein said first discharge means has a curvature capable of discharging the special paper and smaller than the curvature of said third discharge means.

37. A method for controlling an image forming apparatus according to claim 33, wherein said first discharge means has a curvature capable of discharging the special paper.

38. A method for controlling an image forming apparatus, including steps of:

providing first reception means for receiving print data from an external terminal;

providing second reception means for receiving read image data;

providing discrimination means for discriminating whether the reception is made either from said first reception means or said second reception means;

providing recording means for recording an image on a recording medium based on the received data;

providing first discharge means and second discharge means for discharging the recording medium recorded by said recording means;

providing discharge setting means for setting whether to discharge the recording medium to said first discharge means or to said second discharge means respectively corresponding to said first reception means and said second reception means;

providing selection means for selecting either said first discharge means or said second discharge means;

providing first detection means and second detection means for respectively detecting whether said first discharge means and said second discharge means are abnormal; and selecting, by said selection means, said first discharge means regardless of the setting by said discharge setting means in case said second detection means detects an abnormality in said second discharge means and the discharge to said first discharge means is possible, wherein said first discharge means is positioned between said second reception means and said recording means, said second discharge means is so positioned as to be connectable to a post-treatment apparatus and to execute a discharge to an exterior of said image forming apparatus, and said first discharge means is positioned at an upstream side of said second discharge means.

39. A method for controlling an image forming apparatus according to claim 38, further including steps of:

providing third reception means for receiving print data from a public line, wherein said discrimination means discriminates whether the reception is made either from said first reception means or said second reception means or said third reception means, providing third discharge means for discharging the recording medium recorded by said recording means, setting, by said discharge setting means, the discharge of the recording medium to any of said first discharge means, said second discharge means and said third discharge means respectively corresponding to said first reception means, said second reception means and said third reception means, and selecting, by said selection means, any of said first discharge means, said second discharge means or said third discharge means.

40. A method for controlling an image forming apparatus according to claim 39, further including steps of:

providing third detection means for detecting whether said third discharge means is abnormal, and selecting, by said selection means, said first discharge means regardless of the setting by said discharge setting means in case said third detection means detects an abnormality in said third discharge means and the discharge to said first discharge means is possible.

41. A method for controlling an image forming apparatus according to claim 39, wherein said first discharge means and said third discharge means are positioned between said second reception means and said second reception means, said second discharge means is so positioned as to be connectable to a post-treatment apparatus and to execute discharge to the exterior of said image forming apparatus, and said first discharge means is positioned at the upstream side of said second and third discharge means.

42. A method for controlling an image forming apparatus according to claim 41, wherein said first discharge means has a curvature capable of discharging special paper and smaller than the curvature of said third discharge means.

43. A method for controlling an image forming apparatus according to claim 38, wherein said first discharge means has a curvature capable of discharging special paper.

44. A method for controlling an image forming apparatus including steps of:

providing first reception means for receiving print data from an external terminal;

providing second reception means for receiving read image data;

providing discrimination means for discriminating whether the reception is made either from said first reception means or said second reception means;

providing recording means for recording an image on a recording medium based on the received data;

providing first discharge means and second discharge means for discharging the recording medium recorded by said recording means;

providing discharge setting means for setting whether to discharge the recording medium to said first discharge means or to said second discharge means respectively corresponding to said first reception means and said second reception means;

providing selection means for selecting either said first discharge means or said second discharge means;

providing special paper setting means for setting special paper as the type of the recording medium to be recorded by said recording means;

providing post-treatment setting means for setting post-treatment after recording by said recording means;

providing post-treatment means for executing said post-treatment and connected to said second discharge means; and selecting, by said selection means, said first discharge means regardless of the setting by said discharge setting means in case the special paper is set by said special paper setting means, and said selection means selects the second discharge means regardless of the setting by said discharge setting means in case the post-treatment is set by said post-treatment setting means.

45. A method for controlling an image forming apparatus according to claim 44, further including steps of:

providing first detection means and second detection means for respectively detecting whether said first discharge means and said second discharge means are abnormal, and selecting, by said selection means, said first discharge means regardless of the setting by said discharge setting means in case said second detection means detects an abnormality in said second discharge means and the discharge to said first discharge means is possible.

46. A method for controlling an image forming apparatus according to claim 44, further including steps of:

providing third reception means for receiving print data from a public line, wherein said discrimination means discriminates whether the reception is made either from said first reception means or said second reception means or said third reception means, providing third discharge means for discharging the recording medium recorded by said recording means, setting, by said discharge setting means, the discharge of the recording medium to any of said first discharge means, said second discharge means and said third discharge means respectively corresponding to said first reception means, said second reception means and said third reception means, and selecting, by said selection means, any of said first discharge means, said second discharge means or said third discharge means.

47. A method for controlling an image forming apparatus according to claim 46, further including steps of:

providing third detection means for detecting whether said third discharge means is abnormal, and selecting, by said selection means, said first discharge means regardless of the setting by said discharge setting means in case said third detection means detects an abnormality in said third discharge means and the discharge to said first discharge means is possible.

48. A method for controlling an image forming apparatus according to claim 46, wherein said first discharge means and said third discharge means are positioned between a reading means and said recording means, and said second discharge means is so positioned as to connectable to a post-treatment apparatus and to execute discharge to the exterior of said image forming apparatus.

49. A method for controlling an image forming apparatus according to claim 48, wherein said first discharge means has a curvature capable of discharging special paper and smaller than the curvature of said third discharge means.

50. A method for controlling an image forming apparatus according to claim 44, wherein said first discharge means is positioned between a reading means and said recording means, and said second discharge means is so positioned as to be connectable to a post-treatment apparatus and to execute discharge to the exterior of said image forming apparatus.

51. A method for controlling an image forming apparatus according to claim 50, wherein said first discharge means has a curvature capable of discharging special paper.

52. A method for controlling an image forming apparatus provided with first reception means for receiving print data from an external terminal, reading means for reading an image and outputting read print data, and recording means for recording an image on a recording medium based on the received or read data, said method further including steps of:

providing discrimination means for discriminating whether the reception is made either from said first reception means or said reading means;

providing first discharge means and second discharge means for discharging the recording medium recorded by the recording means;

providing sheet discharge setting means for setting whether to discharge the recording medium to said first discharge means or to said second discharge means respectively corresponding to said first reception means and said reading means, wherein said first discharge means is positioned between said reading means and said recording means, and said second discharge means is connectable to a post-treatment apparatus and is so positioned as to discharge the recording medium to the exterior of said image forming apparatus;

providing selection means for selecting said first discharge means or said second discharge means;

providing special paper setting means for setting special paper as the type of the recording medium, providing post-treatment setting means for setting post-treatment after recording by said recording means;

providing post-treatment means for executing said post-treatment; and exclusively selecting said special paper setting means and said post-treatment setting means.

53. A method for controlling an image forming apparatus according to claim 52, wherein said first discharge means has a curvature capable of discharging the special paper.

54. An image forming apparatus comprising:

a first receiver for receiving print data from an external terminal;

a second receiver for receiving read image data;

a discriminator for discriminating whether the reception is made either from said first receiver or said second receiver;

a recorder for recording an image on a recording medium based on the received data;

a first discharger and a second discharges for discharging the recording medium recorded by said recorder;

a discharge setter for setting whether to discharge the recording medium to said first discharger or to said second discharger respectively corresponding to said first receiver and said second receiver;

a selector for selecting either said first discharger or said second discharger;

a special paper setter for setting special paper as the type of the recording medium to be recorded by said recorder;

a post-treatment setter for setting post-treatment after recording by said recorder; and a post-treatment unit for executing said post-treatment and connected to said second discharger, wherein said selector selects said first discharger regardless of the setting by said discharge setter in case the special paper is set by said special paper setter, and said selector selects the second discharger regardless of the setting by said discharge setter in case the post-treatment is set by said post-treatment setter.

55. An image forming apparatus provided with a first receiver for receiving print data from an external terminal, a reader for reading an image and outputting read print data, and a recorder for recording an image on a recording medium based on the received or read data, the apparatus comprising:

a discriminator for discriminating whether the reception is made either from said first receiver or said reader;

a first discharger and a second discharger for discharging the recording medium recorded by the recorder; and a discharge setter for setting whether to discharge the recording medium to said first discharger or to said second discharger respectively corresponding to said first receiver and said reader;

wherein said first discharger is positioned between said reader and said recorder, and said second discharger is connectable to a post-treatment apparatus and is so positioned as to discharge the recording medium to the exterior of said image forming apparatus;

a selector for selecting said first discharger or said second discharger;

a special paper setter for setting special paper as the type of the recording medium;

a post-treatment setter for setting post-treatment after recording by said recorder; and a post-treatment unit for executing said post-treatment, wherein said special paper setter and said post-treatment setter are exclusively selected.

* * * * *

UNITED STATES PATENT AND TRADEMARK OFFICE

CERTIFICATE OF CORRECTION

PATENT NO. : 6,671,472 B2
DATED : December 30, 2003
INVENTOR(S) : Hideki Shimizu et al.

It is certified that error appears in the above-identified patent and that said Letters Patent is hereby corrected as shown below:

Column 1,
Line 60, “be” should read -- to be --.

Column 3,
Line 5, “According the” should read -- According to the --.

Column 5,
Line 9,”cassette 11, 12, 13” should read -- cassettes 11, 12, 13, --.
Line 55, “is” (both occurrences) should read -- are --.

Column 8,
Line 3, “Paths.” should read -- paths. --.
Lines 9 and 36, “handing” should read -- handling --.

Column 9,
Line 2, “includes” should read -- include --.

Column 12,
Line 33, “handing” should read -- handling --.
Line 49, “sheet (S113),” should read -- sheet (S113) is set, --.
Line 57, “handing” should read -- handling --.

Column 15,
Line 46, “pickup” should read -- picking --.

Column 17,
Line 63, “sheet by” should read -- sheet is detected by --.

Column 19,
Line 39, “handing” should read -- handling --.

Column 21,
Line 5, “handing” should read -- handling --.

Figure 5:
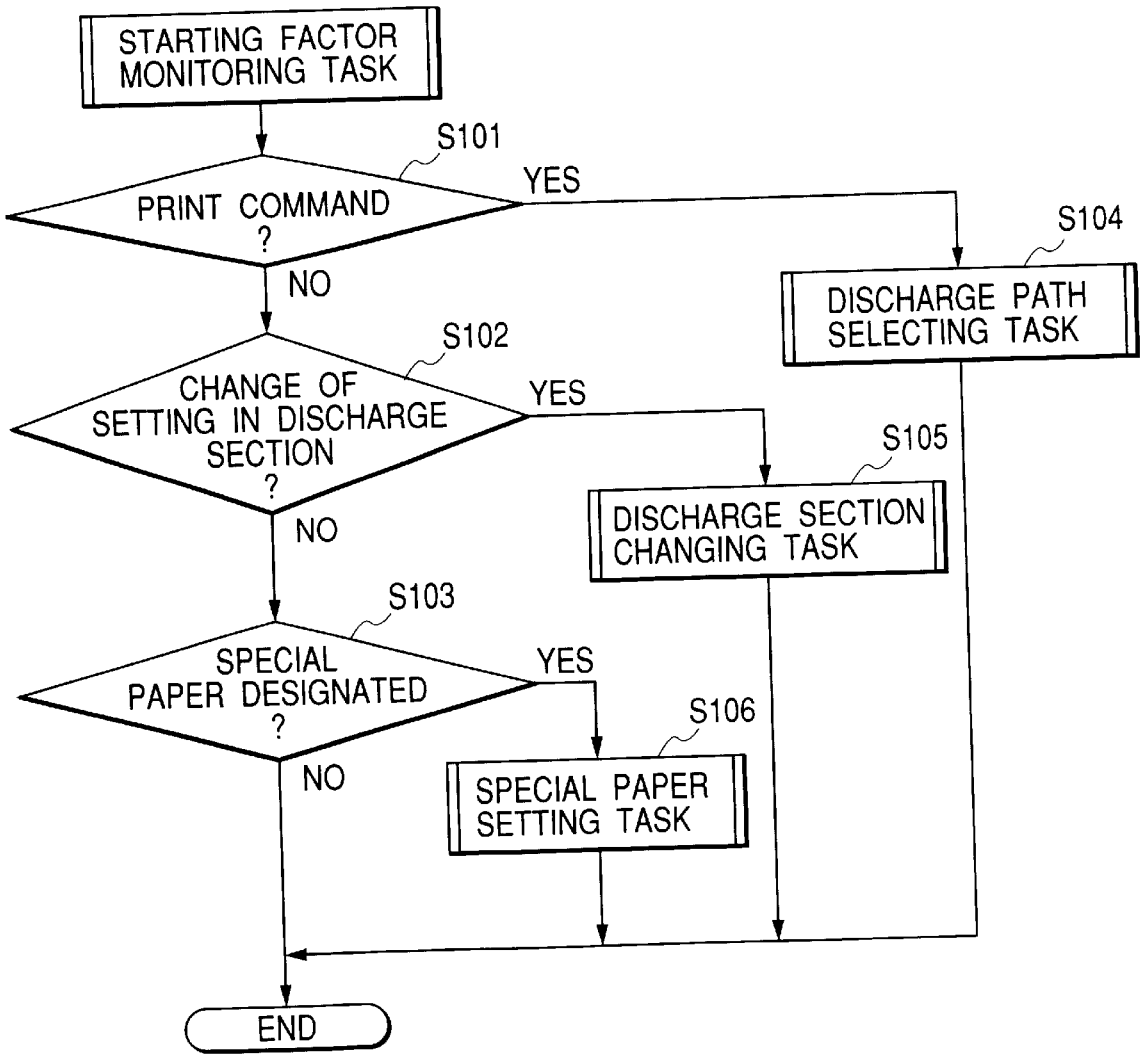
FIG. 5 is a flow chart of a starting factor monitoring task to be executed by a main CPU 101 shown in FIG. 2.

Column 25,
Line 31, “Fig. 5 28.” should read -- Fig. 28. --.
Line 49, “handing” should read -- handling --.
Line 58, “the” should be deleted.

UNITED STATES PATENT AND TRADEMARK OFFICE

CERTIFICATE OF CORRECTION

PATENT NO. : 6,671,472 B2
DATED : December 30, 2003
INVENTOR(S) : Hideki Shimizu et al.

It is certified that error appears in the above-identified patent and that said Letters Patent is hereby corrected as shown below:

Column 27,
Line 39, "is 5 the" should read -- is the --.
Line 61, "on" should read -- one --.

Column 28,
Line 16, after "operation" insert the following paragraphs:

--Also in the in-body sheet discharge configuration as in the foregoing embodiments, it is difficult to reduce the curvature of the conveying path in the second and third discharge paths 23, 24, and the special paper has to be discharged in the first discharge path 22 as explained in the foregoing. In such configuration, therefore, by automatically selecting the first discharge path 22 regardless of the default conditions for controlling the discharge paths in case of designation of special paper, there can be obtained an excellent effect of automatically and appropriately selecting the plural discharge paths without requiring cumbersome selecting operation.

Also a control capable, in case of an error in sheet conveying such as sheet jamming, of selecting a discharge path for discharge different from the discharge path in which the error is detected, provides an excellent effect of automatically and appropriately selecting the plural discharge paths without requiring any cumbersome selecting operation.--.

Line 26, "apparatus in" should read -- apparatus is in --.

Column 29,
Line 24, "apparatus in" should read -- apparatus is in --.
Line 53, "limited 5 even" should read -- limited even --.

Column 34,
Line 13, "connectable" should read -- be connectable --.

Column 38,
Line 39, "between said second reception means and said second reception means," should read -- between said second reception means and said recording means --.

UNITED STATES PATENT AND TRADEMARK OFFICE

CERTIFICATE OF CORRECTION

PATENT NO. : 6,671,472 B2
DATED : December 30, 2003
INVENTOR(S) : Hideki Shimizu et al.

It is certified that error appears in the above-identified patent and that said Letters Patent is hereby corrected as shown below:

Column 40,
Line 1, “connectable” should read -- be connectable --.
Line 63, “discharges” should read -- discharger --.

Signed and Sealed this

Twenty-seventh Day of July, 2004

JON W. DUDAS
*Acting Director of the United States Patent and Trademark Office*